US008131002B2

(12) United States Patent
Takewa

(10) Patent No.: US 8,131,002 B2
(45) Date of Patent: Mar. 6, 2012

(54) ELECTRIC-ACOUSTIC TRANSDUCER AND ELECTRONIC DEVICE

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 956 days.

(21) Appl. No.: 12/093,206

(22) PCT Filed: Nov. 9, 2006

(86) PCT No.: PCT/JP2006/322360

§ 371 (c)(1),
(2), (4) Date: May 9, 2008

(87) PCT Pub. No.: WO2007/055271

PCT Pub. Date: May 18, 2007

(65) Prior Publication Data

US 2009/0097694 A1 Apr. 16, 2009

(30) Foreign Application Priority Data

Nov. 11, 2005 (JP) ..... 2005-327205

(51) Int. Cl.
*H04R 1/00* (2006.01)

(52) U.S. Cl. ..... 381/399; 381/419; 381/421

(58) Field of Classification Search ..... 381/399, 381/419, 421, 176, 177
See application file for complete search history.

(56) References Cited

U.S. PATENT DOCUMENTS 3,922,504 A * 11/1975 Kishikawa et al. ..... 381/408
2002/0118856 A1 8/2002 Croft, III et al.
2003/0068063 A1 * 4/2003 Usuki et al. ..... 381/396
2004/0136558 A1 7/2004 Usuki et al.
2006/0050923 A1 3/2006 Croft, III et al.

FOREIGN PATENT DOCUMENTS

| | | |
|---|---|---|
| JP | 51-24222 | 2/1976 |
| JP | 51-024222 | 2/1976 |
| JP | 2001-211497 | 8/2001 |
| JP | 2004-32659 | 1/2004 |
| JP | 2004-531919 | 10/2004 |
| JP | 2004-364247 | 12/2004 |

OTHER PUBLICATIONS

International Search Report mailed Mar. 6, 2007 for International Application No. PCT/JP2006/322360.

* cited by examiner

*Primary Examiner* — Charles Garber
*Assistant Examiner* — Reema Patel
(74) *Attorney, Agent, or Firm* — Wenderoth, Lind & Ponack, LLP

(57) ABSTRACT

An electro-acoustic transducer includes a diaphragm, a casing which is formed with an opening for directly or indirectly supporting the diaphragm, a first magnetic pole section provided on a side of the opening with respect to the diaphragm and having a magnetic pole at a surface which faces the diaphragm, a second magnetic pole section provided on a side of an inner bottom surface of the casing with respect to the diaphragm and having a magnetic pole at least a part of a surface which faces the first magnetic pole section through the diaphragm, and a drive coil provided on the diaphragm and located in a magnetic gap formed by the first and second magnetic pole sections. The magnetic poles of the first and second magnetic pole sections which face each other through the diaphragm have the same polarity. An outer shape of the surface of the first magnetic pole section which faces the diaphragm is smaller than that of the surface of the second magnetic pole section which faces the diaphragm.

9 Claims, 24 Drawing Sheets

ELECTRIC-ACOUSTIC TRANSDUCER AND ELECTRONIC DEVICE

BACKGROUND OF THE INVENTION

1. Technical Field

The present invention relates to an electro-acoustic transducer and an electronic device, and more particularly, to an electro-acoustic transducer used in a home audio, and an electronic device, for example, an audiovisual device such as an audio set, a personal computer, a television, and the like, which includes the electro-acoustic transducer.

2. Background Art

Recently, media such as DVD, DVD-AUDIO, and the like have been popularized, and there is a desire for an electro-acoustic transducer having a high reproduction band in order to reproduce extremely high frequencies included in their contents. To achieve the reproduction of the extremely high frequencies, there have been proposed electro-acoustic transducers as shown in FIGS. 24 and 25 (e.g. refer to Patent Documents 1 and 2). FIG. 24 is a cross-sectional view showing a configuration of a conventional electro-acoustic transducer 91. FIG. 25 is a cross-sectional view showing a configuration of a conventional electro-acoustic transducer 92.

As shown in FIG. 24, the electro-acoustic transducer 91 includes a yoke 911, a magnet 912, a diaphragm 913, and drive coils 914*a* and 914*b*. The yoke 911 is a member having a recessed shape, and formed of magnetic material such as iron, or the like. Side portions of the yoke 911 extend upward so as to be perpendicular to a bottom thereof. The magnet 912 is a neodymium magnet which is polarized in an up-down direction. The magnet 912 is a columnar body. The magnet 912 is fixed to an inner bottom surface of the yoke 911. Between side surfaces of the magnet 912 and inner side surfaces of the yoke 911 are respectively formed magnetic gaps G1 and G2 which have the same width. An upper surface of the magnet 912 is flush with upper surfaces of the side portions of the yoke 911. The diaphragm 913 is fixed to the upper surface of the magnet 912 and the upper surfaces of the sides of the yoke 911. The drive coil 914*a* is fixed to an upper surface of the diaphragm 913 so as to be located in or adjacent to the magnetic gap G1. The drive coil 914*b* is fixed to the upper surface of the diaphragm 913 so as to be located in or adjacent to the magnetic gap G2.

A magnetic pole at the upper surface of the magnet 912 is assumed to be a north pole. At this time, a magnetic flux emitted from a central portion of the upper surface of the magnet 912 is emitted vertically and upwardly from the upper surface of the magnet 912, and extends vertically and downwardly through the drive coils 914*a* and 914*b*. On the other hand, a magnetic flux emitted from an outer peripheral portion of the upper surface of the magnet 912 spreads radially from the upper surface of the magnet 912, and extends obliquely and downwardly through the drive coils 914*a* and 914*b*. When a current flow through the drive coils 914*a* and 914*b* in such a magnetic field, driving forces in the up-down direction are generated in the drive coils 914*a* and 914*b*, respectively. The driving forces vibrate the diaphragm 913 in the up-down direction.

As shown in FIG. 25, the electro-acoustic transducer 92 includes a lower casing 921, an upper casing 922, a first magnet 923, a second magnet 924, a diaphragm 925, and a drive coil 926. The lower casing 921 and the upper casing 922 are box-shaped members, and formed of non-magnetic material. The lower casing 921 and the upper casing 922 are combined to form a casing. The first and second magnets 923 and 924 are cylindrical bodies. The first magnet 923 has the same outer diameter as that of the second magnet 924. The first magnet 923 is fixed to an inner upper surface of the upper casing 922. The upper casing 922 is formed with openings 922*h* at a part of a bottom thereof, to which the first magnet 923 is not fixed. The second magnet 924 is fixed to an inner bottom surface of the lower casing 921. The first magnet 923 has a central axis which coincides with that of the second magnet 924. The first magnet 923 is polarized in an up-down direction. The second magnet 924 is polarized in the up-down direction but in a direction opposite to the polarization direction of the first magnet 923. The diaphragm 925 is fixed at an outer peripheral portion thereof to the lower casing 921 and the upper casing 922 so that the outer peripheral portion thereof is interposed between the lower casing 921 and the upper casing 922. The drive coil 926 is fixed to an upper surface of the diaphragm 925 so as to include a line connecting an outer periphery of the first magnet 923 to an outer periphery of the second magnet 924.

When a magnetic pole at a lower surface of the first magnet 923 is assumed to be a north pole, a magnetic pole at an upper surface of the second magnet 924 is a north pole. Thus, a magnetic flux emitted vertically and downwardly from the lower surface of the first magnet 923 bends substantially at a right angle to become a horizontal magnetic flux. Similarly, a magnetic flux emitted vertically and upwardly from the upper surface of the second magnet 924 bends substantially at a right angle to become a horizontal magnetic flux. When a current flows through the drive coil 926 in such a static magnetic field, a driving force in the up-down direction is generated in the drive coil 926. The driving force vibrates the diaphragm 925 in the up-down direction to emit sound from the diaphragm 925. The sound emitted from the diaphragm 925 is released through the openings 922*h* to the outside.

[Patent Document] Japanese Laid-Open Patent Publication No. 2001-211497

[Patent Document] Japanese Laid-Open Patent Publication No. 2004-32659

In the conventional electro-acoustic transducer 91 shown in FIG. 24, however, the magnetic flux parallel to the vibration direction is more dominant than the magnetic flux perpendicular to the vibration direction. The driving forces generated in the drive coils 914*a* and 914*b* are proportional to a magnetic flux in a direction perpendicular to the direction of the current flowing through the drive coils 914*a* and 914*b* and the vibration direction of the diaphragm. In other words, the driving forces are proportional to a magnetic flux in a direction perpendicular to the vibration direction. Thus, in the conventional electro-acoustic transducer 91 shown in FIG. 24, since the magnetic flux parallel to the vibration direction is more dominant, sufficient driving forces cannot be obtained. As a result, there is a problem that a sound pressure level of reproduced sound is lowered.

Further, the conventional electro-acoustic transducer 91 shown in FIG. 24 includes only the one magnet 912. Here, there are considered a case where the diaphragm 913 is vibrated upwardly (in a direction to separate from the magnet 912) from an initial state where a current does not flow though the drive coils 914*a* and 914*b*, and a case where the diaphragm 913 is vibrated downwardly (in a direction to approach the magnet 912) from the initial state. A magnetic flux emitted from a magnet decreases in proportion to a distance from the magnet. Thus, the magnetic fluxes extending through the drive coils 914*a* and 914*b* are different in magnitude from each other in each of the cases. In other words, driving forces generated in the drive coils 914*a* and 914*b* are different from each other depending on the vibration direction. As a result, in the conventional electro-acoustic transducer 91 shown in FIG. 24, there is a problem that asymmetric nature of the magnetic fluxes causes distortion of the driving forces thereby deteriorating a quality of the reproduced sound.

In addition, the conventional electro-acoustic transducer 92 as shown in FIG. 25 includes, in addition to the second magnet 924, the first magnet 923 for increasing the magnetic flux in the direction perpendicular to the vibration direction to obtain a sufficient driving force. However, the first magnet 923 is located on a sound emission surface side with respect to the diaphragm 925. Thus, the first magnet 923 becomes an acoustic load with respect to the sound emitted from the diaphragm 925. The first magnet 923 has the same outer diameter as that of the second magnet 924. Thus, in the conventional electro-acoustic transducer 92 shown in FIG. 25, there is a problem that an effect of the acoustic load by the first magnet 923 is significant, thereby deteriorating a quality of reproduced sound. Particularly in an extremely high frequency band equal to or higher than 20 kHz, the quality of the reproduced sound is significantly deteriorated by the acoustic load.

Therefore, an object of the present invention is to provide an electro-acoustic transducer and an electronic device which are capable of reproducing high-quality sound while increasing a driving force generated in a drive coil and preventing deterioration of a sound quality due to distortion of the driving force.

SUMMARY OF THE INVENTION

To achieve the above objects, the present invention has the following aspects. The present invention is an electro-acoustic transducer comprising: a diaphragm; a casing which is formed with an opening in a part thereof for directly or indirectly supporting therein the diaphragm; a first magnetic pole section which is provided on a side of the opening with respect to the diaphragm and has a magnetic pole at a surface thereof which faces the diaphragm; a second magnetic pole section which is provided on a side of an inner bottom surface of the casing with respect to the diaphragm and has a magnetic pole at least a part of a surface thereof which faces the first magnetic pole section through the diaphragm; and a drive coil which is provided on the diaphragm so as to be located in a magnetic gap formed by the first and second magnetic pole sections for generating a driving force so as to cause the diaphragm to vibrate in a direction perpendicular to a surface of the diaphragm. The magnetic poles of the first and second magnetic pole sections which face each other through the diaphragm have the same polarity, and an outer shape of the surface of the first magnetic pole section which faces the diaphragm is smaller than that of the surface of the second magnetic pole section which faces the diaphragm. For example, the first magnetic pole section corresponds to a component constructed of a first magnet 12, and a component constructed of the first magnet 12 and a first yoke 30 in later-described embodiments. Also, for example, the second magnetic pole section corresponds to a component constructed of a second magnet 13, a component constructed of the second magnet 13 and a second yoke 31, and a component constructed of second magnets 13*b* and 13*c* and a third yoke 33 in the later-described embodiments.

According to the present invention, an effect of an acoustic load by the first magnetic pole section, which exists on a sound emission surface side with respect to the diaphragm, can be suppressed. As a result, an electro-acoustic transducer can be provided, which is capable of reproducing high-quality sound while increasing the driving force generated in the drive coil and preventing deterioration of a sound quality due to distortion of the driving force.

Preferably, the first magnetic pole section includes a first magnet and a yoke for forming a magnetic path in at least a portion around the first magnet, and the second magnetic pole section includes a second magnet and a yoke for forming a magnetic path in at least a portion around the second magnet.

Thus, the driving force generated in the drive coil is increased further, and a sound pressure level of the reproduced sound can be raised further.

Preferably, the drive coil is provided on the diaphragm and in a position, which is outward of an outer periphery of the surface of the first magnetic pole section, which faces the diaphragm, and inward of an outer periphery of the surface of the second magnetic pole section which faces the diaphragm.

Thus, since a magnetic flux density is increased at the position where the drive coil is provided, the sound pressure level of the reproduced sound can be raised further.

Preferably, the first magnetic pole section includes a first magnet which is a columnar body and provided on the surface of the first magnetic pole section which faces the diaphragm, the second magnetic pole section includes a second magnet which is a columnar body and provided on the surface of the second magnetic pole section which faces the first magnet through the diaphragm, and polarization directions of the first and second magnets are a vibration direction of the diaphragm, and opposite to each other.

Thus, by using the first and second magnets which are the columnar bodies, an electro-acoustic transducer can be provided, which is capable of reproducing high-quality sound while increasing the driving force generated in the drive coil and preventing deterioration of a sound quality due to distortion of the driving force.

Preferably, the yoke included in the first magnetic pole section is provided only on a surface of the first magnet which has a magnetic pole which is opposite to a magnetic pole of a surface of the first magnet which faces the diaphragm.

Thus, while an effect of an acoustic load by the first magnetic pole section is suppressed, the driving force generated in the drive coil can be increased further.

Preferably, the yoke included in the second magnetic pole section is provided so as to surround surfaces of the second magnet other than a surface of the second magnet which faces the diaphragm.

Thus, the driving force generated in the drive coil is increased further, and the sound pressure level of the reproduced sound can be raised further.

Preferably, a ratio of an area of a surface of the first magnet, which faces the diaphragm, to an area of a surface of the second magnet, which faces the diaphragm, ranges from 40% to 70%.

Thus, an electro-acoustic transducer can be provided, which has an optimum characteristic for practical use concerning an increased amount of the sound pressure level and a depth of a dip in a sound pressure frequency characteristic.

Preferably, the drive coil has an elongated rectangular shape, each of the first and second magnets is an elongated rectangular parallelepiped having long sides parallel to a long side portion of the drive coil, the first magnet has the same width in a long side direction thereof as that of the second magnet in a long side direction thereof, and the first magnet has a width in a short side direction thereof, which is smaller than that of the second magnet in a short side direction thereof.

Thus, an electro-acoustic transducer, which has an elongated outer shape with a large aspect ratio, can be provided.

Preferably, the long side portion of the drive coil is provided on the diaphragm and in a position which includes a line connecting an outer periphery of the first magnet in the short side direction thereof to an outer periphery of the second magnet in the short side direction thereof.

Thus, since the magnetic flux density is maximized at the position where the drive coil is provided, the sound pressure level of the reproduced sound can be raised further.

Preferably, the drive coil has a circular shape, each of the first and second magnets is a cylindrical body, and the first magnet has an outer diameter which is smaller than that of the second magnet.

Thus, an electro-acoustic transducer, which has a circular outer shape, can be provided.

Preferably, the drive coil is provided on the diaphragm and in a position which includes a line connecting an outer periphery of the first magnet to an outer periphery of the second magnet.

Thus, since the magnetic flux density is maximized at the position where the drive coil is provided, the sound pressure level of the reproduced sound can be raised further.

Preferably, the drive coil has an elongated rectangular shape, the first magnetic pole section includes a first magnet which is provided on the surface thereof facing the diaphragm and which is an elongated rectangular parallelepiped having long sides parallel to a long side portion of the drive coil, the second magnetic pole section includes: a yoke which has a center pole, which has an elongated rectangular parallelepiped shape having long sides parallel to the long side portion of the drive coil and which is formed in a position which faces the first magnet through the diaphragm; and two second magnets which are provided so as to surround side surfaces of the center pole in a long side direction of a surface of the center pole which faces the first magnet, and each of which is an elongated rectangular parallelepiped having long sides parallel to the long side portion of the drive coil, and polarization directions of the first magnet and each of the second magnets are a vibration direction of the diaphragm, and the same as each other.

Thus, the second magnet can be effectively used at the second magnetic pole section which does not become an acoustic load, and a magnetic flux density in the magnetic gap can be increased. Further, a range in which the drive coil is capable of being disposed is wider than that in a conventional electro-dynamic electro-acoustic transducer which uses a voice coil. Thus, degree of freedom in designing the drive coil and the diaphragm is increased.

Preferably, the first magnet has the same width in a long side direction thereof as that of each of the second magnets in a long side direction thereof, and the first magnet has a width in a short side direction thereof, which is smaller than that of the second magnetic pole section, which includes each of the second magnets and the yoke, in a short side direction thereof.

Thus, the effect of the acoustic load by the first magnet, which exists on the sound emission surface side with respect to the diaphragm, can be suppressed.

Preferably, the long side portion of the drive coil is provided on the diaphragm and in a space formed by linearly connecting a side surface of the first magnet in a long side direction of the surface of the first magnet, which faces the diaphragm, to a side surface of the second magnet which exists on a side of the side surface of the first magnet and faces the center pole.

Thus, since the magnetic flux density is maximized at the position where the drive coil is provided, the sound pressure level of the reproduced sound can be raised further.

Preferably, the first magnetic pole section includes a first magnet which is a columnar body and provided on the surface thereof which faces the diaphragm, the second magnetic pole section includes: a yoke which has a columnar-body-shaped center pole which is formed at a position which faces the first magnet through the diaphragm; and a second magnet which is an annular body and provided on the yoke so that the center pole is located in a space formed at a center of the second magnet, and polarization directions of the first and second magnets are a vibration direction of the diaphragm, and the same as each other.

Thus, the second magnet which is the annular body can be effectively used, and the magnetic flux density in the magnetic gap can be increased. Further, a range in which the drive coil is capable of being disposed is wider than that in a conventional electro-dynamic electro-acoustic transducer which uses a voice coil. Thus, degree of freedom in designing the drive coil and the diaphragm is increased.

Preferably, the drive coil has an elongated shape, the first magnet is an elongated rectangular parallelepiped having long sides parallel to a long side portion of the drive coil, the second magnet is an elongated annular body having a long side portion parallel to the long side portion of the drive coil, the first magnet has the same width in a long side direction thereof as that of the second magnet in a long side direction thereof, and the first magnet has a width in a short side direction thereof, which is smaller than that of the second magnet in a short side direction thereof.

Thus, the second magnet which is the elongated annular body can be effectively used, and the magnetic flux density in the magnetic gap can be increased. Further, a range in which the drive coil is capable of being disposed is wider than that in a conventional electro-dynamic electro-acoustic transducer which uses a voice coil. Thus, degree of freedom in designing the drive coil and the diaphragm is increased.

Preferably, the drive coil has a circular shape, the first magnet is a cylindrical body, the second magnet is a circular and annular body, the first magnet has an outer diameter which is smaller than an outermost diameter of the second magnet.

Thus, the second magnet which is the circular and annular body can be effectively used, and the magnetic flux density in the magnetic gap can be increased. Further, a range in which the drive coil is capable of being disposed is wider than that in a conventional electro-dynamic electro-acoustic transducer which uses a voice coil. Thus, degree of freedom in designing the drive coil and the diaphragm is increased.

Preferably, the diaphragm has one of a circular shape, a rectangular shape, an elliptical shape, and a track shape.

Thus, the outer shape of the electro-acoustic transducer can be a shape in accordance with the shape of the diaphragm.

The present invention is also directed to an electronic device, and for solving the above problem, the electronic device of the present invention comprises the electro-acoustic transducer and a device casing in which the electro-acoustic transducer is disposed.

Thus, an electro-acoustic transducer can be provided, which is capable of reproducing high-quality sound while increasing the driving force generated in the drive coil and preventing deterioration of a sound quality due to distortion of the driving force.

The present invention is also directed to an audiovisual device, and for solving the above problem, the audiovisual device of the present invention comprises the electro-acoustic transducer and a device casing in which the electro-acoustic transducer is disposed.

Thus, an electro-acoustic transducer can be provided, which is capable of reproducing high-quality sound while increasing the driving force generated in the drive coil and preventing deterioration of a sound quality due to distortion of the driving force. As a result, an audiovisual device which provides a large screen can be provided. Further, an audiovisual device can be provided, which provides a high reproduced sound pressure and a high sound quality and is excellent in reproducing sound in a high frequency region.

According to the present invention, an electro-acoustic transducer and an electronic device can be provided which are capable of reproducing high-quality sound while increasing a driving force generated in a drive coil and preventing deterioration of a sound quality due to distortion of the driving force.

DESCRIPTION OF THE REFERENCE CHARACTERS

Figure 1:
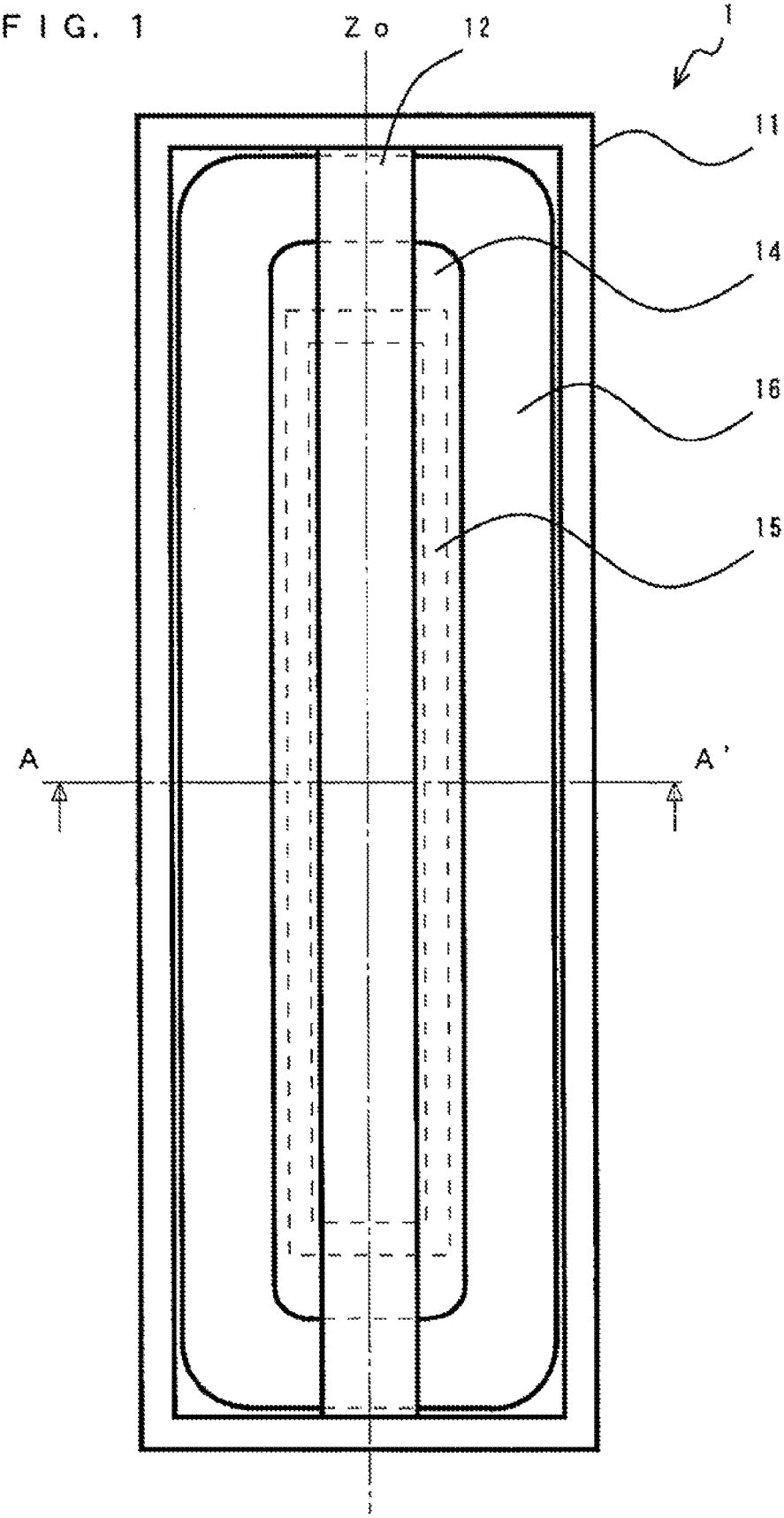
FIG. 1 is a front view of an electro-acoustic transducer 1 according to a first embodiment.

1, 2, 3 electro-acoustic transducer
10, 10*a* lower casing
11, 11*a* upper casing
12, 12*a* first magnet
13, 13*a*, 13*b*, 13*c*, 13*d* second magnet
14, 14*a* diaphragm
15, 15*a* drive coil
16, 16*a* edge
20 supporting member
30, 30*a*, 30*b* first yoke
31, 31*a*, 31*b*, 31*c* second yoke
33, 33*a*, 33*b* third yoke
50 flat screen television
51 display section
52 device casing

DETAILED DESCRIPTION OF THE INVENTION (First Embodiment)

Figure 2:
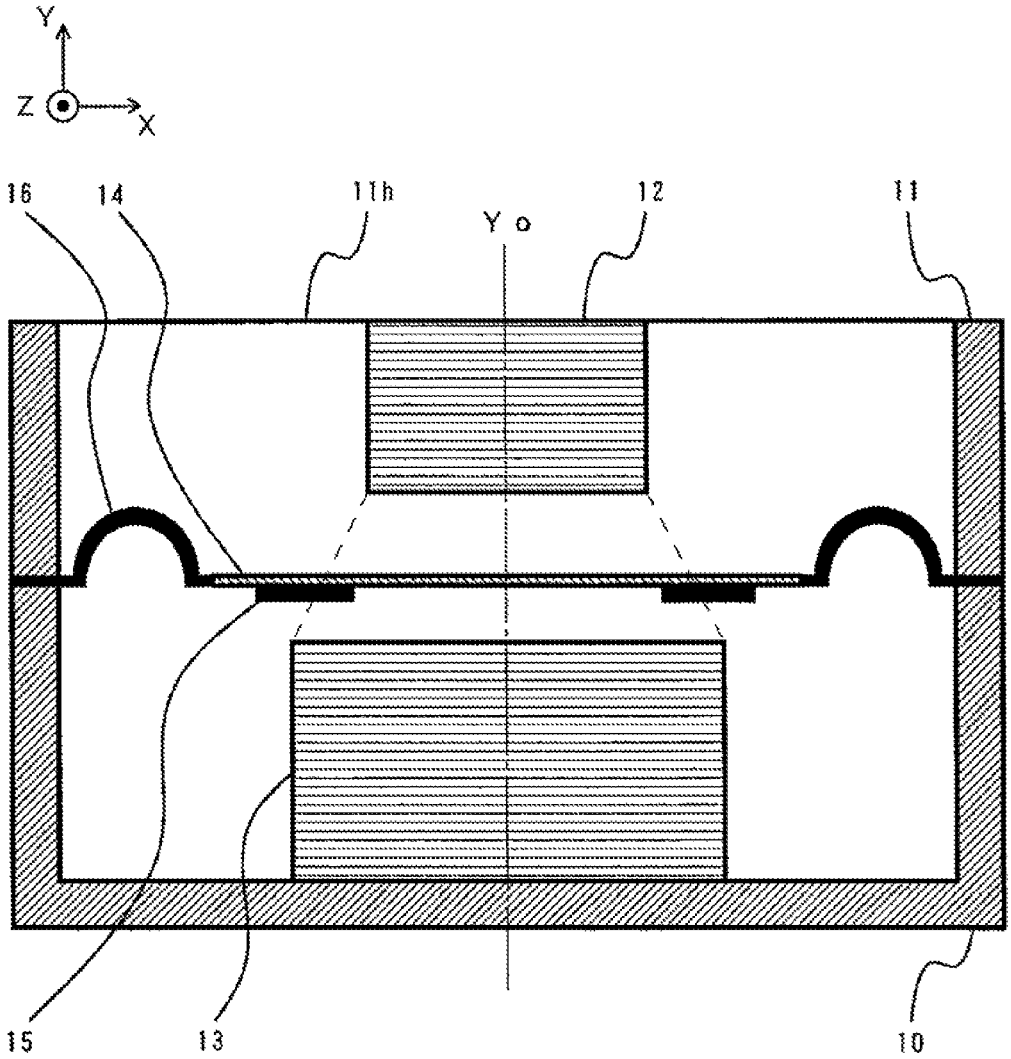
FIG. 2 is a cross-sectional view of the electro-acoustic transducer 1 taken along the line A-A' shown in FIG. 1.

With reference to FIGS. 1 and 2, an electro-acoustic transducer 1 according to a first embodiment of the present invention will be described. FIG. 1 is a front view of the electro-acoustic transducer 1 according to the first embodiment. Lines Zo shown in FIG. 1 and later-described FIG. 7 indicate a center of the electro-acoustic transducer 1 in a left-right direction as viewed toward sheet surfaces thereof. FIG. 2 is a cross-sectional view of the electro-acoustic transducer 1 taken along the line A-A' shown in FIG. 1. Lines Yo shown in FIG. 2 and later-described FIGS. 3, 8, 9, and 10 indicate a central axis of the electro-acoustic transducer 1 which is parallel to a thickness direction of the electro-acoustic transducer 1. It is noted that in FIG. 2 and later-described FIGS. 3 and 8, as viewed toward sheet surfaces thereof, a left-right direction is an X-axis direction, and its rightward direction is a positive direction. Also, as viewed toward the sheet surfaces, an up-down direction is a Y-axis direction, and its upward direction is a positive direction. Further, a direction perpendicular to the X-axis and Y-axis directions is a Z-axis direction, and a direction directed from the sheet surfaces toward a viewer is a positive direction.

As shown in FIG. 1, a front shape of the electro-acoustic transducer 1 is an elongated shape. As shown in FIG. 2, the electro-acoustic transducer 1 includes a lower casing 10, an upper casing 11, a first magnet 12, a second magnet 13, a diaphragm 14, a drive coil 15, and an edge 16.

The lower casing 10 is a box-shaped member in which a surface in the Y-axis positive direction is opened. The upper casing 11 is a cylindrical member in which surfaces in the Y-axis positive and negative directions are opened. The lower casing 10 and the upper casing 11 are combined to form a casing in which a surface in the Y-axis positive direction is opened. As material for forming the lower casing 10 and the upper casing 11, non-magnetic material such as resin material and the like, for example, ABS and PC (polycarbonate), is used.

The first magnet 12 is constructed of an elongated rectangular parallelepiped. As the first magnet 12, for example, a neodymium magnet having an energy product of 44 MGOe, and the like is used. The first magnet 12 has the same width in a long side direction thereof (the Z-axis direction) as an inner width of the upper casing 11 in a long side direction thereof (the Z-axis direction). As shown in FIG. 1, two side surfaces of the first magnet 12, which are parallel to the short side direction thereof, are fixed to inner surfaces of the upper casing 11, respectively. Thus, the first magnet 12 is supported by the upper casing 11 in the long side direction thereof. The upper casing 11 is formed with an opening **11*h* in a part of an upper surface thereof, in which the first magnet 12** is not disposed, for emitting sound therethrough to the outside.

The second magnet 13 is constructed of an elongated rectangular parallelepiped. As the second magnet 13, for example, a neodymium magnet having an energy product of 44 MGOe, and the like is used. The second magnet 13 has the same width in a long side direction thereof (the Z-axis direction) as that of the first magnet 12 in the long side direction thereof. The second magnet 13 is fixed to an inner bottom surface of the lower casing 10.

The first magnet 12 and the second magnet 13 are disposed so that central axes thereof coincide with the central axis Yo. Upper and lower surfaces of the first magnet 12 and upper and lower surfaces of the second magnet 13 are magnetic pole surfaces each having a magnetic pole. Between the first magnet 12 and the second magnet 13, a magnetic gap is formed. A magnetic flux in the magnetic gap will be described in detail later.

The diaphragm 14 has an elongated rectangular shape, and is disposed in a space between the first magnet 12 and the second magnet 13. In other words, the diaphragm 14 is disposed so as to face each of the first and second magnets 12 and 13. An outer peripheral portion of the diaphragm 14 is fixed to an inner peripheral portion of the edge 16. A cross-sectional shape of the edge 16 is a semicircular shape. An outer peripheral portion of the edge 16 is fixed between upper surfaces of side portions of the lower casing 10 and lower surfaces of side portions of the upper casing 11. In other words, the outer peripheral portion of the edge 16 is interposed between the lower casing 10 and the upper casing 11. Thus, the edge 16 supports the diaphragm 14 so as to allow the diaphragm 14 to vibrate in a direction perpendicular to a surface of the diaphragm 14 (in the Y-axis direction).

The drive coil 15 has an elongated rectangular shape, and is disposed on the diaphragm 14 so as to be concentric with the first and second magnets 12 and 13. The drive coil 15 is disposed so that a long side portion thereof is parallel to each long side of the first and second magnets 12 and 13. Also, the drive coil 15 is disposed on the diaphragm 14 so as to be located in the magnetic gap formed by the first and second magnets 12 and 13. The drive coil 15 is fixed, for example, to a lower surface of the diaphragm 14 by an adhesive. The drive coil 15 is formed, for example, by winding a coil wire.

The following will describe polarization directions of the first and second magnets 12 and 13. The polarization direction of the first magnet 12 is a vibration direction of the diaphragm 14 (the Y-axis direction). On the other hand, the second magnet 13 is polarized in the vibration direction but in a direction opposite to the polarization direction of the first magnet 12. For example, when the magnetic pole of the lower surface of the first magnet 12 is a north pole, the magnetic pole of the upper surface of the second magnet 13 is a north pole. In other words, the magnetic pole of the lower surface of the first magnet 12 has the same polarity as that of the upper surface of the second magnet 13.

The following will describe a relation between a width of the first magnet 12 in the short side direction thereof (the X-axis direction) and a width of the second magnet 13 in a short side direction thereof (the X-axis direction). As shown in FIG. 2, the width of the first magnet 12 in the short side direction thereof is smaller than that of the second magnet 13 in the short side direction thereof. Thus, when the first and second magnets 12 and 13 are projected on the diaphragm 14, a projected area of the first magnet 12 is smaller than that of the second magnet 13. For example, the diaphragm 14 has a width of 60 mm in the long side direction thereof (the Z-axis direction) and a width of 6 mm in the short side direction thereof (the X-axis direction). Also, the cross-section of the edge 16 has a radius of 1.5 mm. Further, the second magnet 13 has a width of 3.5 mm in the short side direction thereof. In the present embodiment, for example, the first magnet 12 has a width of 2 mm in the short side direction thereof. Here, there is considered a case where the first magnet 12 has a width of 3.5 mm in the short side direction thereof. In this case, the first magnet 12 has an area equivalent to about 60% of an area of the diaphragm 14. On the other hand, in a case where the first magnet 12 has a width of 2 mm in the short side direction thereof, the first magnet 12 has only an area equivalent to about 30% of the area of the diaphragm 14. In other words, by causing the width of the first magnet 12 in the short side direction thereof to be smaller than that of the second magnet 13 in the short side direction thereof, a ratio of the area of the first magnet 12 to the area of the diaphragm 14 becomes significantly small compared to that in a case where the width of the first magnet 12 in the short side direction thereof is the same as that of the second magnet 13 in the short side direction thereof. Thus, an acoustic load by the first magnet 12 is reduced, and a quality of reproduced sound is prevented from deteriorating due to the acoustic load.

Figure 3:
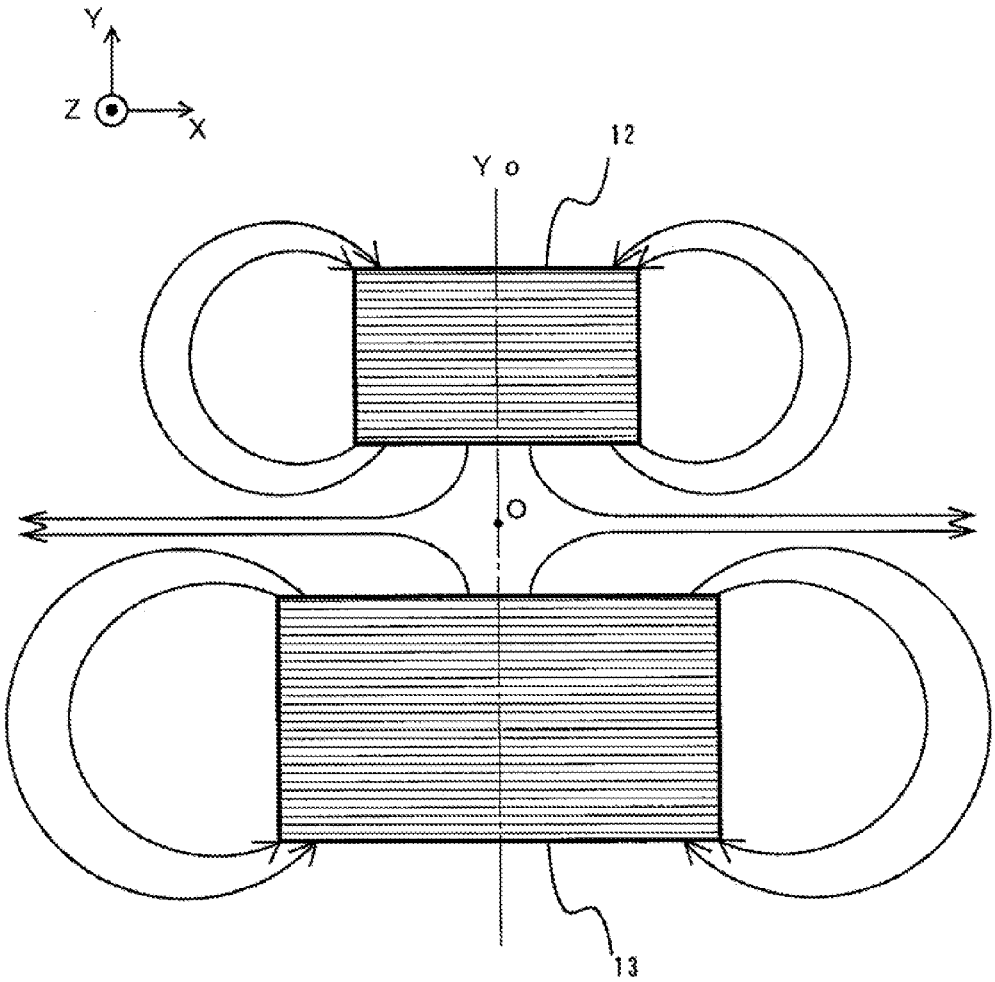
FIG. 3 is a view showing a static magnetic field, which is formed by first and second magnets 12 and 13, by using vectors of magnetic fluxes.

The following will describe an operation of the electro-acoustic transducer 1 shown in FIGS. 1 and 2. A static magnetic field, which is formed by the first and second magnets 12 and 13 when an alternating current electric signal is not inputted to the drive coil 15, will be now described with reference to FIG. 3. FIG. 3 is a view showing a static magnetic field, which is formed by the first and second magnets 12 and 13, by using vectors of magnetic fluxes. In FIG. 3, an arrow indicates a vector of a magnetic flux, and a direction of the arrow indicates a direction of the magnetic flux. A point O shown in FIG. 3 is a point which is located on the central axis Yo and at a center between the first magnet 12 and the second magnet 13.

The first and second magnets 12 and 13 are polarized so that the polarization directions thereof are opposite to each other. Thus, when the magnetic poles of the lower surface of the first magnet 12 and the upper surface of the second magnet 13 are the north poles, a magnetic flux emitted from the lower surface of the first magnet 12 and a magnetic flux emitted from the upper surface of the second magnet 13 repel each other. Thus, as shown in FIG. 3, the magnetic flux emitted from each of the first and second magnets 12 and 13 bends in a direction perpendicular to the vibration direction of the diaphragm 14 (in the X-axis direction). The magnetic fluxes in the X-axis direction become magnetic fluxes proportional to a driving force. Thus, in the electro-acoustic transducer 1 shown in FIG. 2, the magnetic fluxes in the direction perpendicular to the vibration direction are dominant.

Figure 4:
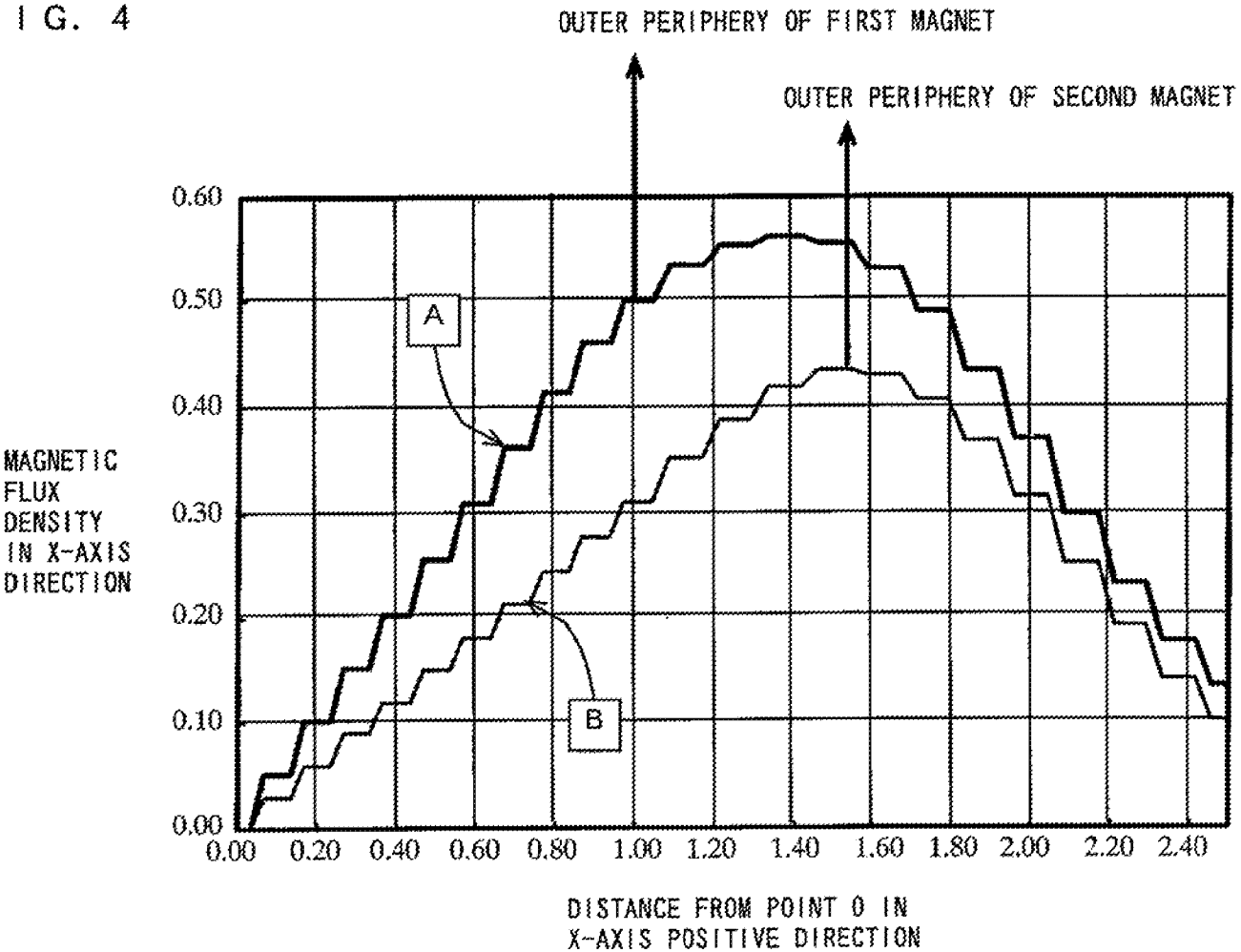
FIG. 4 is a view showing a relation between a distance from a point O shown in FIG. 3 in an X-axis positive direction and a magnetic flux density.
Figure 24:
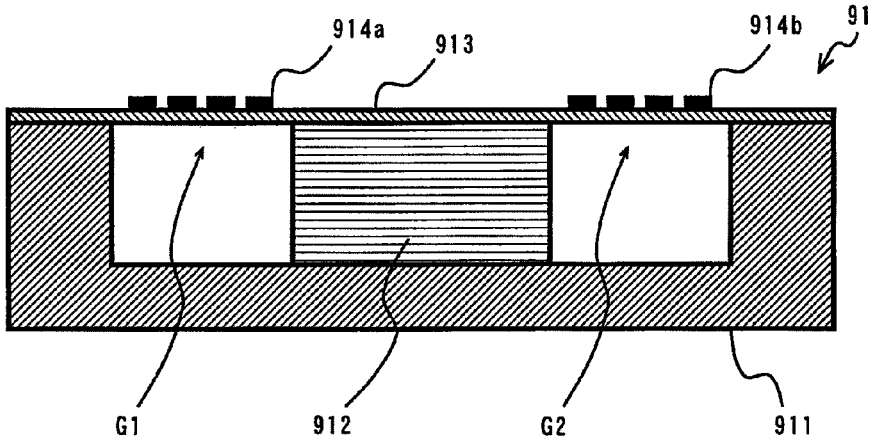
FIG. 24 PRIOR ART
FIG. 24 is a cross-sectional view showing a configuration of a conventional electro-acoustic transducer 91.
Figure 25:
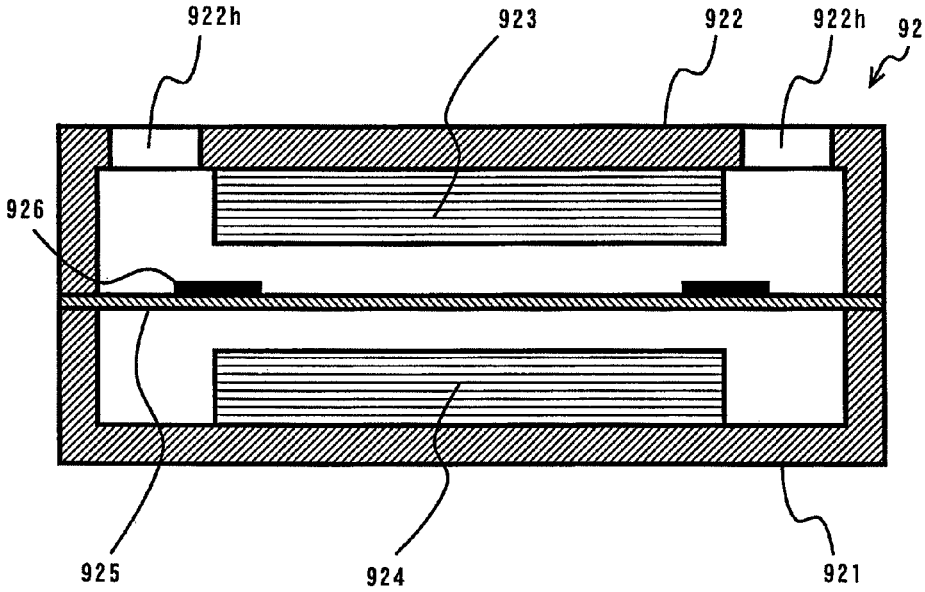
FIG. 25 PRIOR ART
FIG. 25 is a cross-sectional view showing a configuration of a conventional electro-acoustic transducer 92.

A relation between a distance from the point O in the X-axis positive direction and a magnetic flux density in the static magnetic field shown in FIG. 3 is indicated by a curve (A) in FIG. 4. FIG. 4 is a view showing a relation between a distance from the point O in the X-axis positive direction and a magnetic flux density. In FIG. 4, a vertical axis indicates a magnetic flux density in the X-axis direction, and a horizontal axis indicates a distance from the point O in the X-axis positive direction. Two arrows shown in FIG. 4 indicate a position of an outer periphery of the first magnet 12 in the short side direction thereof and a position of an outer periphery of the second magnet 13 in the short side direction thereof, respectively. The curve (A) shown in FIG. 4 is a curve indicated by the electro-acoustic transducer 1 according to the present embodiment, and a curve (B) shown in FIG. 4 is a curve indicated by the conventional electro-acoustic transducer 91 shown in FIG. 24. When the curve (A) and the curve (B) are compared to each other, the curve (A) shows higher magnetic flux densities in the X-axis direction. This is because the electro-acoustic transducer 1 according to the present embodiment uses two magnets while the conventional electro-acoustic transducer 91 uses only one magnet. Thus, it is realized that a sound pressure level of the reproduced sound of the electro-acoustic transducer 1 according to the present embodiment is higher by about 3 dB than that of the conventional electro-acoustic transducer 91.

In addition, a peak of the curve (A) exists between the outer periphery of the first magnet 12 in the short side direction thereof and the outer periphery of the second magnet 13 in the short side direction thereof. Thus, preferably, the long side portion of the drive coil 15 may be provided on the diaphragm 14 and between the outer periphery of the first magnet 12 in the short side direction thereof and the outer periphery of the second magnet 13 in the short side direction hereof. This enhances the sound pressure level of the reproduced sound.

Further, the magnetic flux density indicated by the curve (A) becomes maximum at a position on a line connecting the outer periphery of the first magnet 12 in the short side direction thereof to the outer periphery of the second magnet 13 in the short side direction thereof. Thus, more preferably, the long side portion of the drive coil 15 may be provided in a position which includes the line connecting the outer periphery of the first magnet 12 in the short side direction thereof to the outer periphery of the second magnet 13 in the short side direction thereof. This can maximize the sound pressure level of the reproduced sound. It is noted that a dotted line shown in FIG. 2 is the line connecting the outer periphery of the first magnet 12 in the short side direction thereof to the outer periphery of the second magnet 13 in the short side direction thereof. More specifically, two dotted lines exist, a left-side long side portion of the drive coil 15 which constitutes the long side portion of the drive coil 15 is located at a position of the left-side dotted line on the diaphragm 14, and a right-side long side portion of the drive coil 15 which constitutes the long side portion of the drive coil 15 is located at a position of the right-side dotted line on the diaphragm 14. At this time, it is even better that centers of the left-side and right-side long side portions are located at the positions of the dotted lines, respectively.

The following will describe a case when an alternating current electric signal is inputted to the drive coil 15. When a current flows through the drive coil 15, a driving force in the up-down direction (a direction which is the Y-axis direction and perpendicular to the diaphragm 14) is generated in the drive coil 15 by a magnetic flux in the X-axis direction. The driving force vibrates the diaphragm 14 in the up-down direction, thereby emitting sound from the diaphragm 14. The sound emitted from the diaphragm 14 is released through the opening 11*h* to the outside.

Figure 5A:
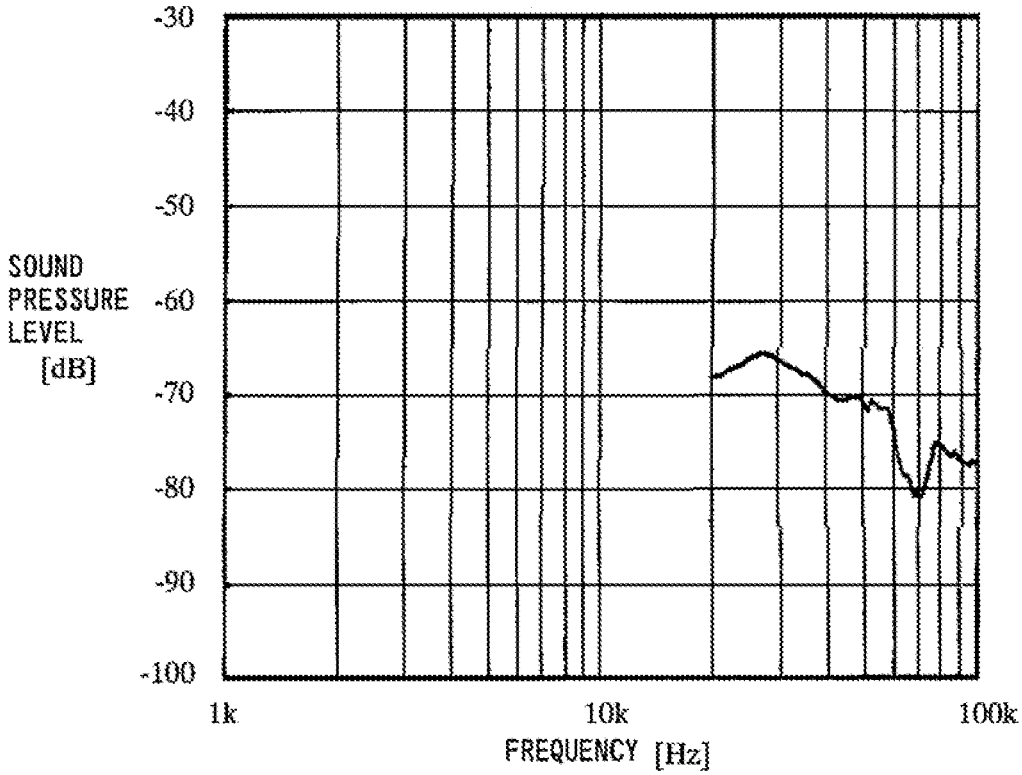
FIG. 5A is a view showing a sound pressure frequency characteristic when the first and second magnets 12 and 13 have the same width in a short side direction thereof.
Figure 5B:
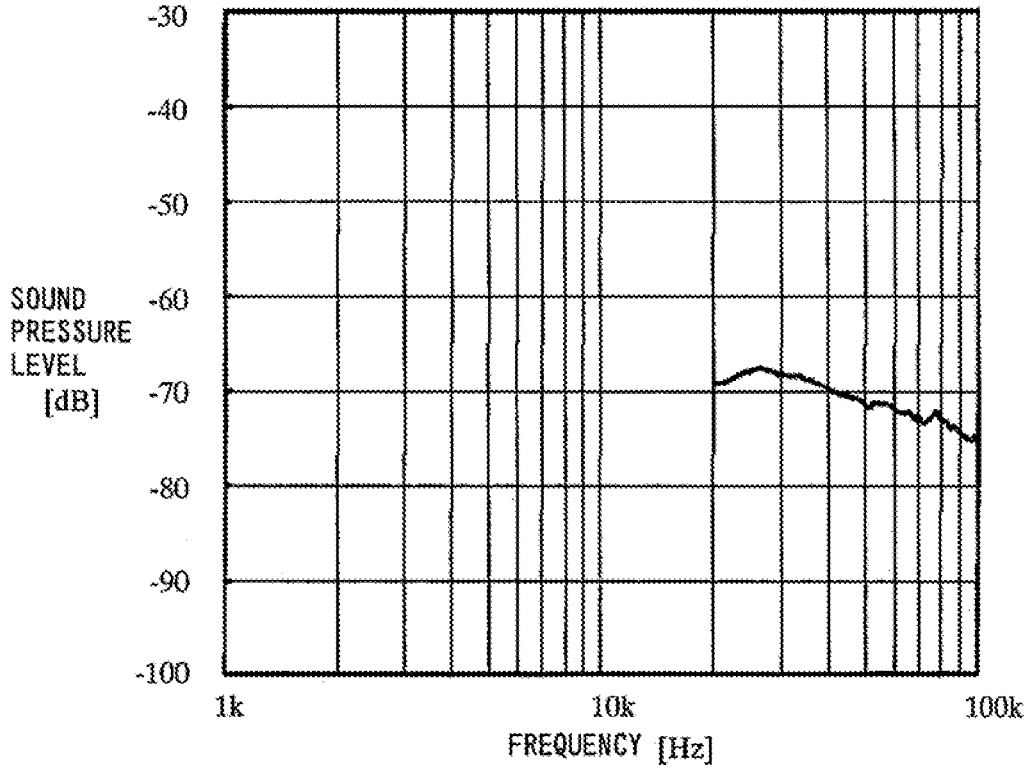
FIG. 5B is a view showing a sound pressure frequency characteristic when the first magnet 12 has a width of 2 mm in the short side direction thereof and the second magnet 13 has a width of 3.5 mm in the short side direction thereof.

With reference to FIG. 5, deterioration of the quality of the reproduced sound by the acoustic load will be considered below. FIG. 5 has views each showing a sound pressure frequency characteristic when the first magnet 12 and the second magnet 13 have predetermined sizes. Of them, FIG. 5A is a view showing a sound pressure frequency characteristic when the first and second magnets 12 and 13 have the same width (3.5 mm) in the short side direction thereof. FIG. 5B is a view showing a sound pressure frequency characteristic when the first magnet 12 has a width of 2 mm in the short side direction thereof and the second magnet 13 has a width of 3.5 mm in the short side direction thereof. As seen from FIG. 5A, when the first and second magnets 12 and 13 have the same width of 3.5 mm in the short side direction thereof, the sound pressure frequency characteristic is disturbed in an extremely high frequency band equal to or higher than 20 kHz. More specifically, a large dip occurs in the vicinity of 70 kHz. This is because the first magnet 12, which is disposed on a sound emission surface side with respect to the diaphragm 14, becomes a large acoustic load, thereby causing cavity resonance.

On the other hand, as seen from FIG. 5B, when the first magnet 12 has the small width in the direction short side thereof, a dip occurs very little in the extremely high frequency band equal to or higher than 20 kHz. In addition, a sound pressure level shown in FIG. 5B is higher than that of the conventional electro-acoustic transducer 91 shown in FIG. 24. Thus, by causing the width of the first magnet 12 in the short side direction thereof to be smaller than that of the second magnet 13 in the short side direction thereof, a dip can be prevented from occurring due to the acoustic load while the driving force generated in the drive coil 15 is increased. Further, since the first magnet 12 and the second magnet 13 are disposed in a facing relation to each other through the diaphragm 14, a sound quality can be prevented from deteriorating due to distortion of the driving force.

Figure 6A:
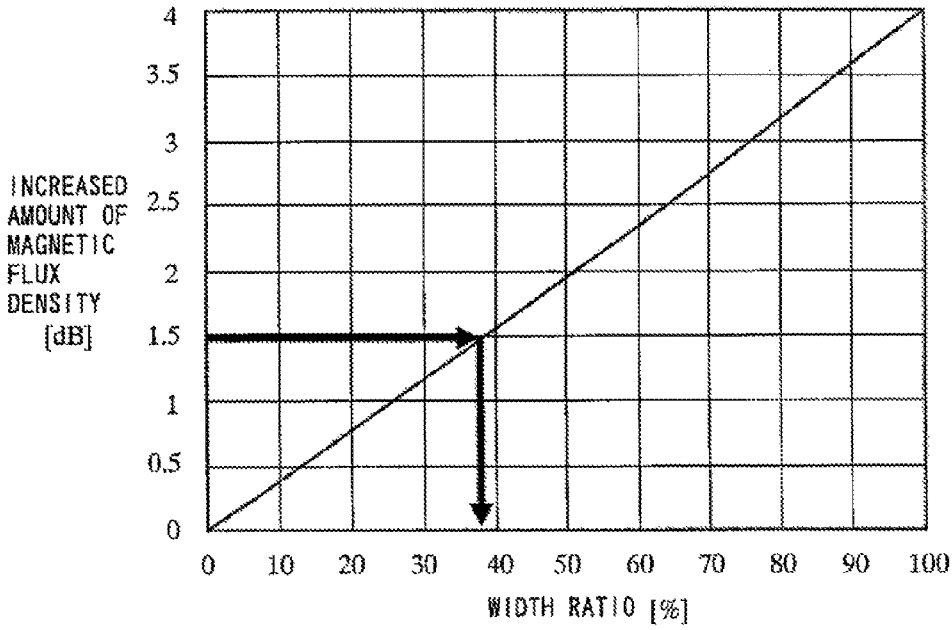
FIG. 6A is a view showing a relation between a ratio of the width of the first magnet 12 in the short side direction thereof to the width of the second magnet 13 in the short side direction thereof and an increased amount of a magnetic flux density.
Figure 6B:
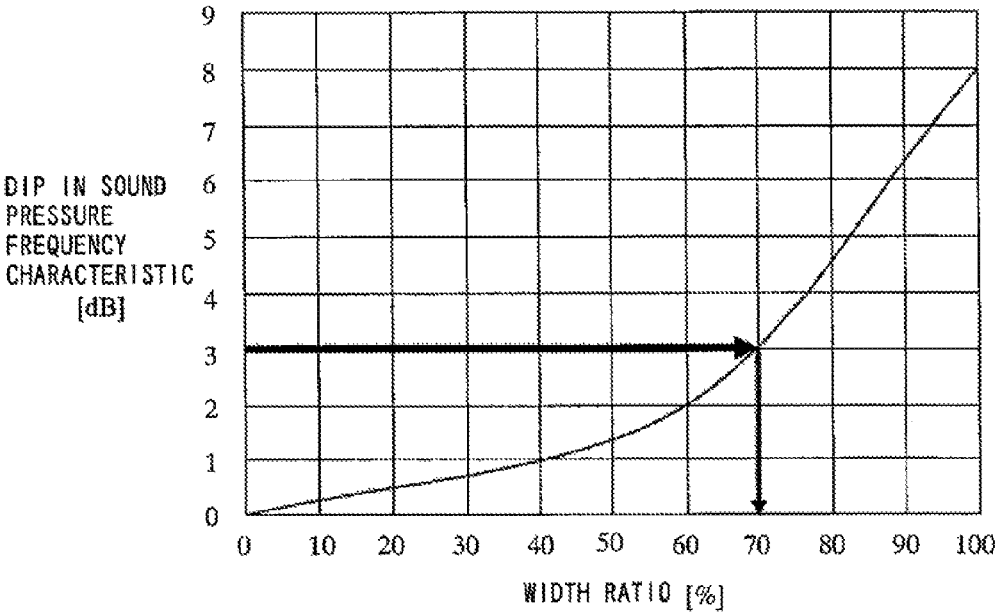
FIG. 6B is a view showing a relation between the width ratio and a depth of a dip in the sound pressure frequency characteristic.

With reference to FIG. 6, the following will describe a relation between the area of the first magnet 12 and the area of the second magnet 13. FIG. 6 has views showing a magnetic flux density and a dip in a sound pressure frequency characteristic when each of the areas of the first magnet 12 and the second magnet 13 is set to a predetermined area. Of them, FIG. 6A is a view showing a relation between a ratio of the width of the first magnet 12 in the short side direction thereof to the width of the second magnet 13 in the short side direction thereof (hereinafter, referred to as a width ratio) and an increased amount of a magnetic flux density. FIG. 6B is a view showing a relation between the width ratio and a depth of a dip in the sound pressure frequency characteristic. It is noted that a magnetic flux density in the magnetic gap when the first magnet 12 does not exist (when the width ratio is 0%) is set as a reference, and the increased amount of the magnetic flux density in FIG. 6A is an amount by which the magnetic flux density increases from the reference magnetic flux density. In FIGS. 6A and 6B, the second magnet 13 has a width of 3.5 mm in the short side direction thereof and a height of 3 mm, and the first magnet 12 has a height of 2 mm. The first and second magnets 12 and 13 have a width of 60 mm in the long side direction thereof.

As shown in FIG. 6A, when the increased amount of the magnetic flux density is 1.5 dB, the width ratio is smaller than 40%. Here, as the magnetic flux density increases, the sound pressure level of the reproduced sound also increases by the increased amount of the magnetic flux density. Thus, according to the result shown in FIG. 6A, for increasing the sound pressure level of the reproduced sound by 1.5 dB or larger, the width ratio may be set to be equal to or larger than 40%.

As shown in FIG. 6B, when the width ratio is 70%, the depth of the dip is 3 dB. Thus, according to the result shown in FIG. 6B, for causing the depth of the dip to be equal to or smaller than 3 dB, the width ratio may be set to be equal to or smaller than 70%.

As described above, from viewpoints of the increased amount of the sound pressure level and the depth of the dip, preferably, the widths of the first and second magnets 12 and 13 in the short side direction thereof may be set so that the width ratio ranges from 40% to 70%. This makes it possible to provide the electro-acoustic transducer 1 having an optimum characteristic for practical use. Since the first and second magnets 12 and 13 have the width of 60 mm in the long side direction thereof, the above width ratio is equivalent to a ratio of an area of the lower surface of the first magnet 12 to an area of the upper surface of the second magnet 13 (hereinafter, referred to as an area ratio). Therefore, the areas of the first and second magnets 12 and 13 may be set so that the area ratio ranges from 40% to 70%.

As described above, in the electro-acoustic transducer 1 according to the present embodiment, the width of the first magnet 12 in the short side direction thereof is smaller than that of the second magnet 13 in the short side direction thereof. In other words, an outer shape of the lower surface of the first magnet 12 is smaller than that of the upper surface of the second magnet 13. Thus, the sound quality can be prevented from deteriorating due to the acoustic load. As a result, an electro-acoustic transducer can be provided, which is capable of reproducing high-quality sound while increasing the driving force generated in the drive coil 15 and preventing a sound quality from deteriorating due to the distortion of the driving force.

Figure 7:
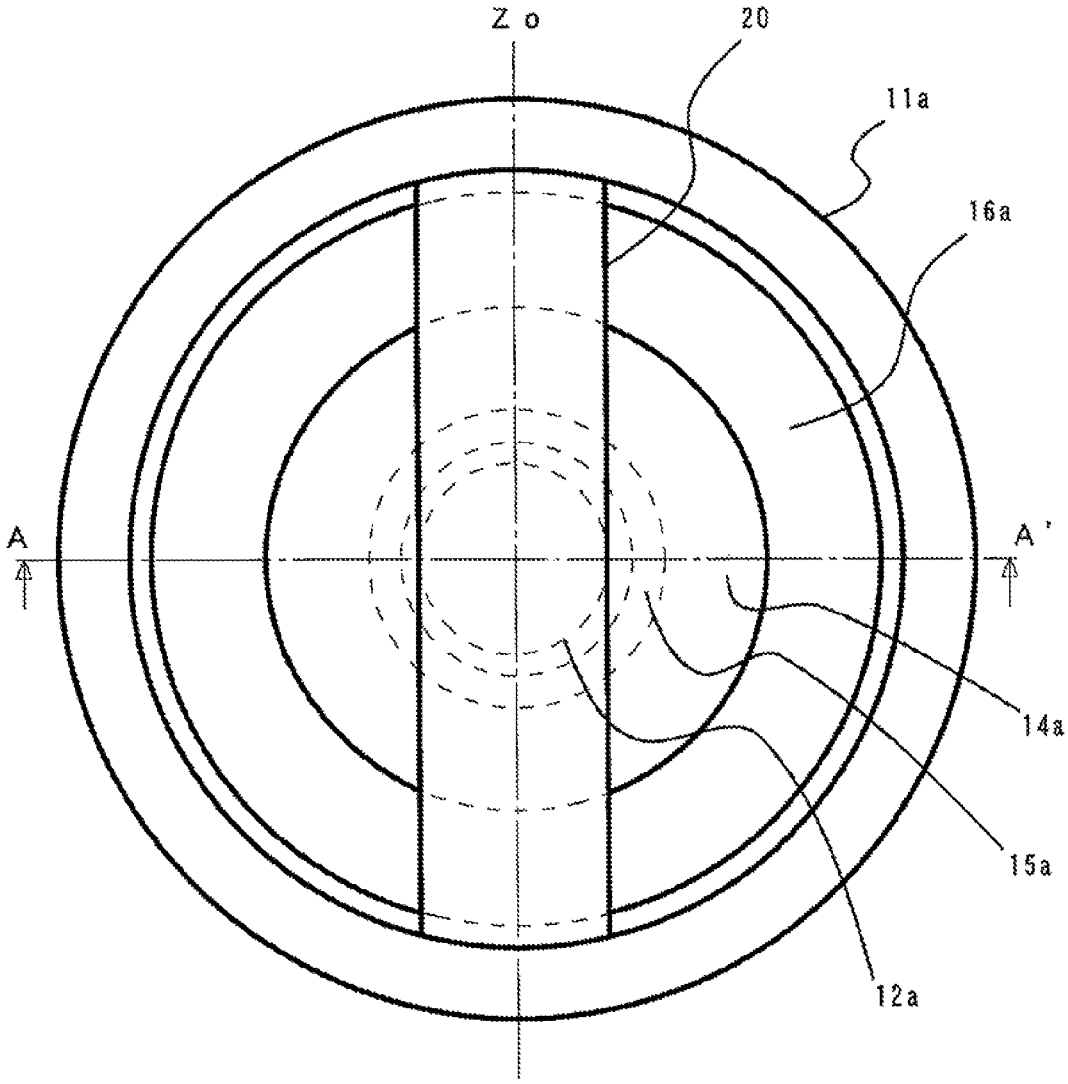
FIG. 7 is a front view of a circular-shaped electro-acoustic transducer 1.
Figure 8:
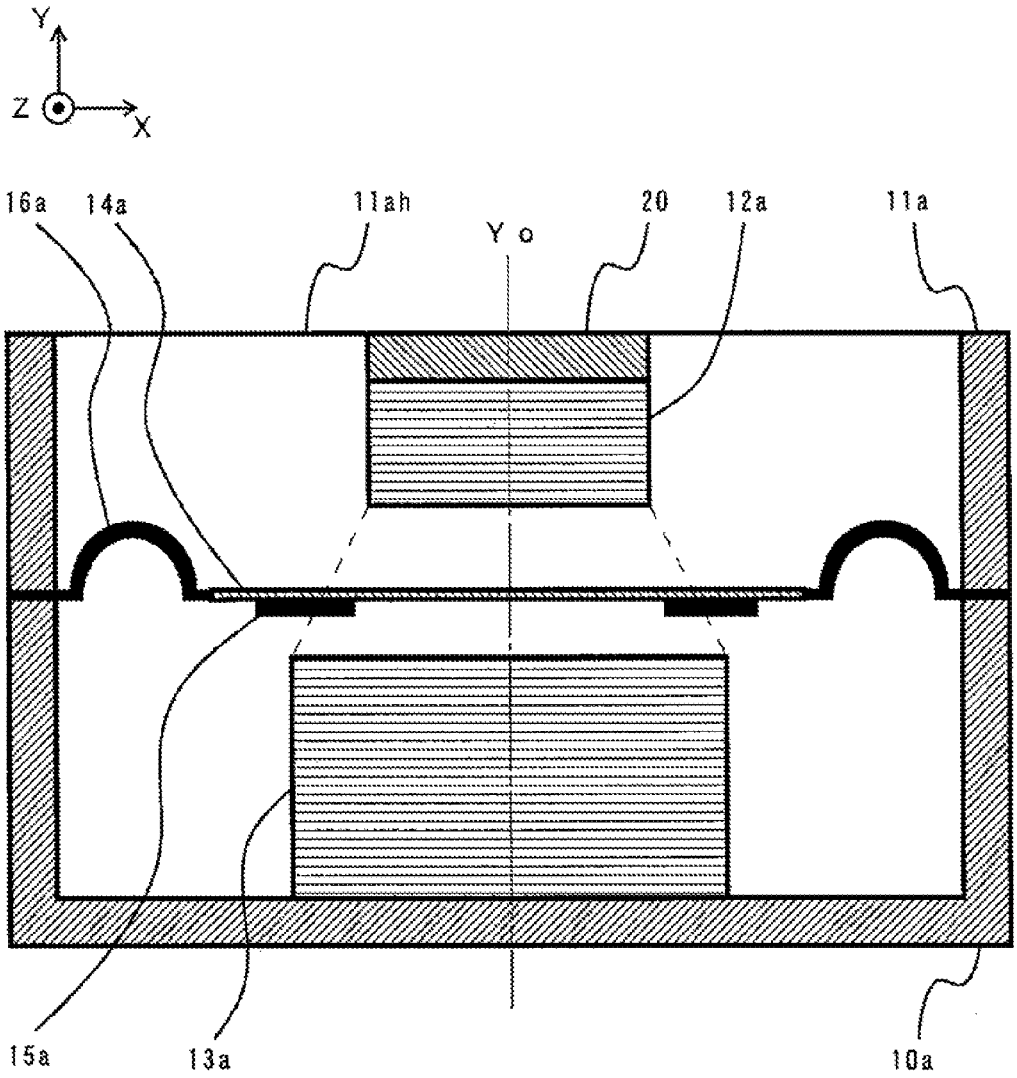
FIG. 8 is a cross-sectional view of the electro-acoustic transducer 1 taken along the line A-A' shown in FIG. 7.

In the configuration shown in FIGS. 1 and 2, the front shape of the electro-acoustic transducer 1 is the elongated shape, and a shape of each component such as the first magnet 12, the second magnet 13, and the like is a shape in accordance with the elongated shape. However, the present invention is not limited thereto. For example, as shown in FIGS. 7 and 8, the front shape of the electro-acoustic transducer 1 may be a circular shape, and the shape of each component such as the first magnet 12, the second magnet 13, and the like may be a shape in accordance with the circular shape. FIG. 7 is a front view of the circular-shaped electro-acoustic transducer 1. FIG. 8 is a cross-sectional view of the electro-acoustic transducer 1 taken along the line A-A' shown in FIG. 7. In the electro-acoustic transducer 1 shown in FIGS. 7 and 8, the lower casing 10 and the upper casing 11 of the electro-acoustic transducer 1 shown in FIGS. 1 and 2, which have the elongated shapes, are replaced with a circular-shaped lower casing 10*a* and a circular-shaped upper casing 11*a*, respectively. Similarly, the first and second magnets 12 and 13, which are constructed of the elongated rectangular parallelepipeds, are replaced with first and second magnets 12*a* and 13*a* which are constructed of cylindrical bodies, respectively. Further, the diaphragm 14 having the elongated shape is replaced with a circular-shaped diaphragm 14*a*, the drive coil 15 having the elongated rectangular shape is replaced with a circular-shaped drive coil 15*a*, and the edge 16 which is formed in an elongated annular shape is replaced with an edge 16*a* which is formed in a circular and annular shape. Thus, the electro-acoustic transducer 1 shown in FIGS. 7 and 8 is different in front shape from the electro-acoustic transducer 1 shown in FIGS. 1 and 2, and has a configuration to further include a supporting member 20 which supports the first magnet 12*a*.

As shown in FIG. 8, the lower casing 10*a* is combined with the upper casing 11*a* to form a casing in which a surface in the Y-axis positive direction is opened. The supporting member 20 is formed of, for example, non-magnetic material, and fixed to an inner surface of the upper casing 11*a*. The first magnet 12 is fixed to the supporting member 20. Thus, the first magnet 12*a* is supported by the supporting member 20 so as to face the second magnet 13*a* through the diaphragm 14*a*. The upper casing 11*a* is formed with an opening 11*ah* in a portion of an upper surface thereof, in which the supporting member 20 is not disposed, for emitting sound therethrough. The second magnet 13*a* is fixed to an inner bottom surface of the lower casing 10*a*. The first magnet 12*a* and the second magnet 13*a* are disposed so that central axes thereof coincide with the central axis Yo. Upper and lower surfaces of the first magnet 12*a* and upper and lower surfaces of the second magnet 13*a* are magnetic pole surfaces each having a magnetic pole. Between the first magnet 12*a* and the second magnet 13*a*, a magnetic gap is formed. A polarization direction of the first magnet 12*a* is the Y-axis direction. On the other hand, the second magnet 13*a* is polarized in the Y-axis direction but in a direction opposite to the polarization direction of the first magnet 12*a*. The first magnet 12*a* has an outer diameter which is smaller than that of the second magnet 13*a*. In other words, an outer shape of the lower surface of the first magnet 12*a* is smaller than that of the upper surface of the second magnet 13*a*.

The diaphragm 14*a* is disposed so as to face each of the first and second magnets 12*a* and 13*a*. An outer peripheral portion of the diaphragm 14*a* is fixed to an inner peripheral portion of the edge 16*a*. An outer peripheral portion of the edge 16*a* is fixed between an upper surface of a side portion of the lower casing 10*a* and a lower surface of a side portion of the upper casing 11*a*. The edge 16*a* supports the diaphragm 14*a* so as to allow the diaphragm 14*a* to vibrate in the Y-axis direction. The drive coil 15*a* is provided on the diaphragm 14*a* so as to be located in the magnetic gap formed by the first magnet 12*a* and the second magnet 13. It is noted that when the drive coil 15*a* is located in a position which includes a line connecting an outer periphery of the first magnet 12*a* to an outer periphery of the second magnet 13*a*, the sound pressure level of the reproduced sound can be maximized.

Alternatively, for example, the front shape of the electro-acoustic transducer 1 may be an elliptical shape, a rectangular shape, or a racetrack-like shape in which facing two sides of a rectangle are each formed in a shape of a semi-circle (hereinafter, referred to as a track shape). With this, the shape of each component such as the first magnet 12, the second magnet 13, and the like may be a shape in accordance with the front shape of the electro-acoustic transducer 1. For example, the diaphragm 14 has a shape such as a circular shape, a rectangular shape, an elliptical shape, a track shape, or the like.

Figure 9A:
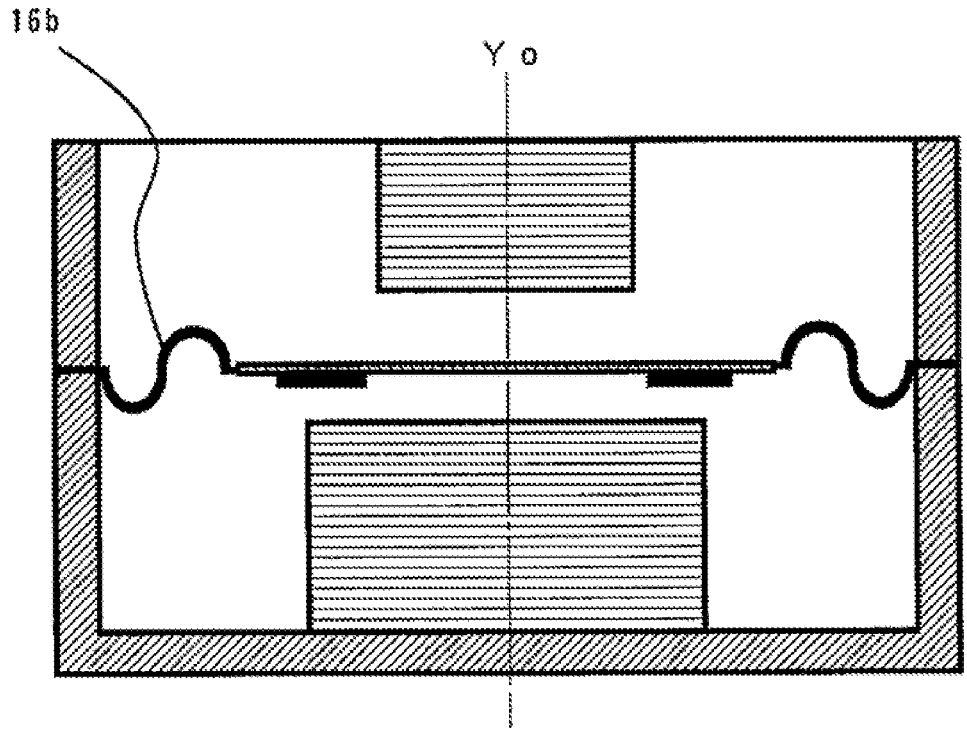
FIG. 9A is a view showing a configuration when a cross-sectional shape is a corrugated shape.
Figure 9B:
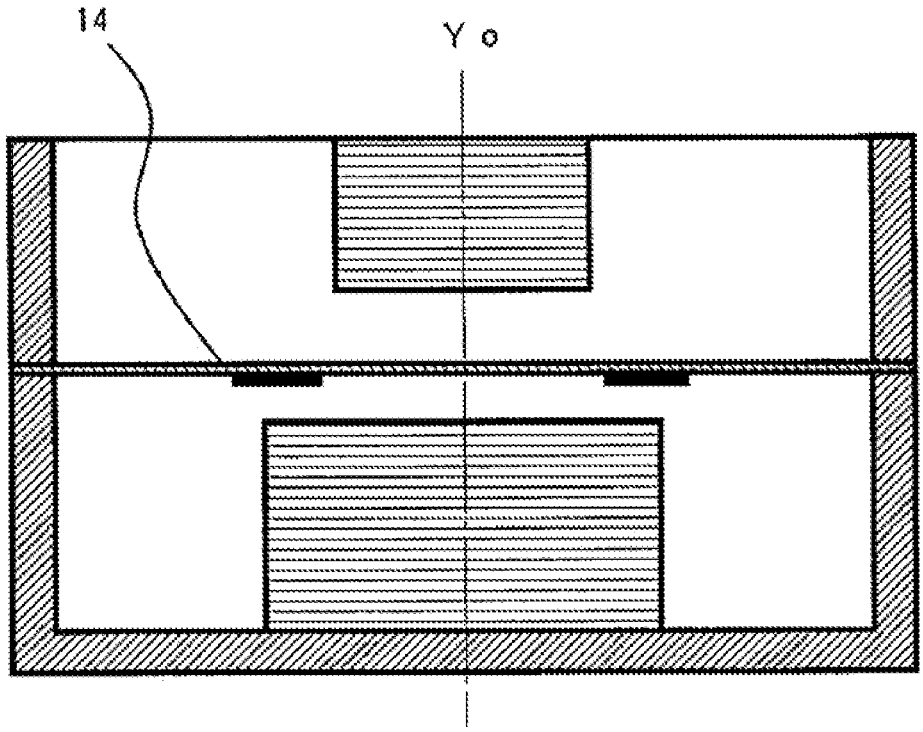
FIG. 9B is a cross-sectional view showing a configuration in which an edge 16 is removed.

In the configuration shown in FIG. 2, the cross-sectional shape of the edge 16 is the semicircular shape. However, the present invention is not limited thereto. As shown in FIG. 9A, an edge 16*b*, a cross-sectional shape of which is a corrugated shape, may be used in place of the edge 16, the cross-sectional shape of which is the semicircular shape. FIG. 9A is a view showing a configuration when the cross-sectional shape is a corrugated shape. Alternatively, the cross-sectional shape of the edge 16 may be a plate shape. In the configuration shown in FIG. 2, the edge 16 is provided, but the present invention is not limited thereto. As shown in FIG. 9B, a configuration may be provided, in which the edge 16 is removed. FIG. 9B is a cross-sectional view showing a configuration in which the edge 16 is removed. In this case, the outer peripheral portion of the diaphragm 14 acts as the edge 16. Concerning a type of the cross-sectional shape of the edge and existence/non-existence of the edge, selection is made as appropriate for obtaining a desired minimum resonant frequency and desired maximum amplitude.

Figure 10:
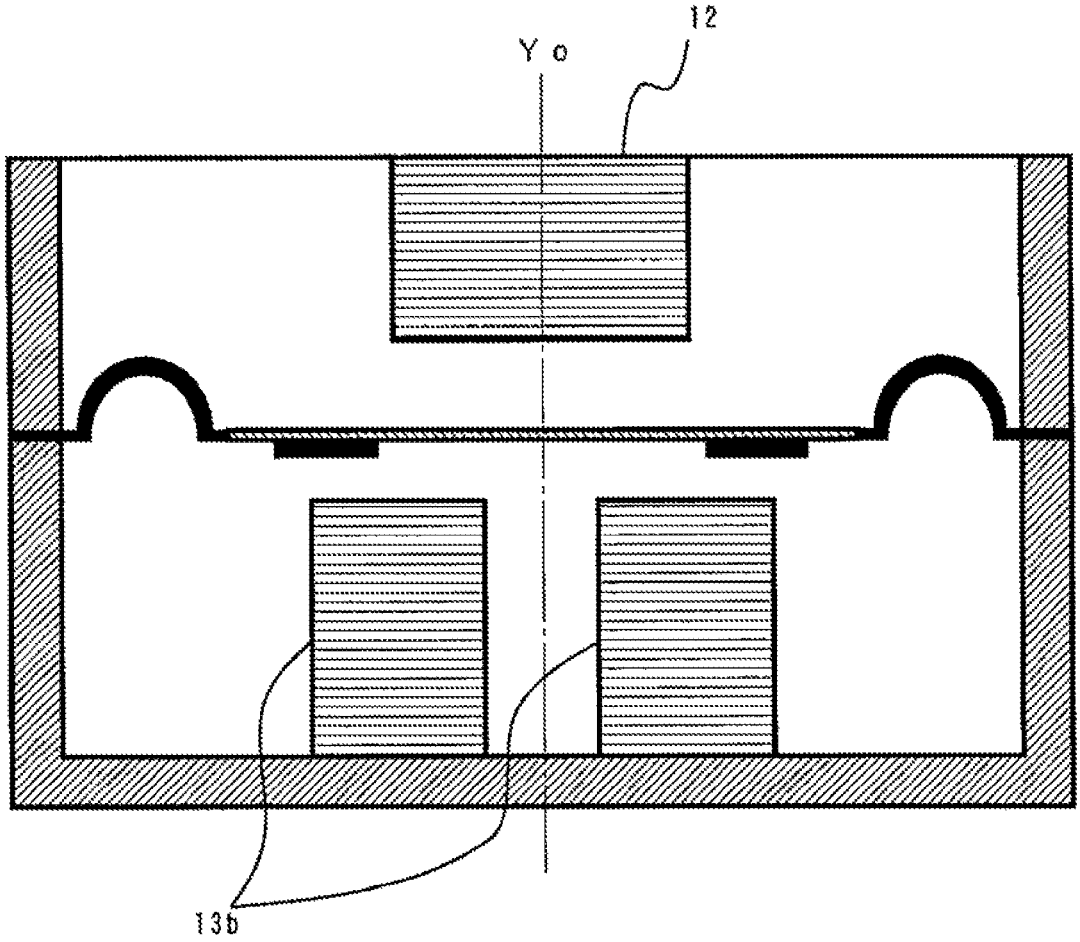
FIG. 10 is a cross-sectional view showing a configuration in which the second magnet 13, which is an elongated rectangular parallelepiped, is replaced with a second magnet 13*b* which is an elongated annular body.

In the configuration shown in FIGS. 1 and 2, the first magnet 12 and the second magnet 13 are the elongated rectangular parallelepipeds. However, for example, the first magnet 12 and the second magnet 13 may have other shapes such as an elongated annular shape, and the like. FIG. 10 is a cross-sectional view showing a configuration in which the second magnet 13, which is the elongated rectangular parallelepiped, is replaced with a second magnet 13*b* which is a rectangular and annular body. In the configuration shown in FIG. 10, the first magnet 12 has an outer shape which is smaller than that of the second magnet 13*b*.

In the configuration shown in FIGS. 1 and 2, the drive coil 15 is formed by winding a coil wire, and provided independently of the diaphragm 14. However, the present invention is not limited thereto. The drive coil 15 may be formed by printed wiring which is formed on the diaphragm 14. In this case, the drive coil 15 is integral with the diaphragm 14. A method for forming the printed wiring includes a method for forming printed wiring by vapor deposition, printing, and the like. By forming the drive coil 15 by the printed wiring, a coil wire is not needed, so that a maximum power input is improved. Further, a bonding process and withdrawal of a lead wire are eliminated, so that production efficiency is improved.

In the configuration shown in FIGS. 1 and 2, the neodymium magnets are used as the first and second magnets 12 and 13. However, the present invention is not limited thereto. In accordance with a target sound pressure level of the reproduced sound, a shape of the magnet, and the like, a magnet such as a ferrite magnet, a samarium-cobalt magnet, and the like may be used as appropriate.

In the configuration shown in FIGS. 1 and 2, the non-magnetic material is used for the lower casing 10 and the upper casing 11. However, magnetic material may be used for the lower casing 10 and the upper casing 11. By using the magnetic material, a magnetic flux leaking from the first and second magnets 12 and 13 to the casing can be reduced.

In the configuration shown in FIGS. 1 and 2, the opening 11*h* is formed in the upper surface of the upper casing 11. However, an opening may be provided in another portion. For, example, openings may be formed in the side portions of the lower casing 10 and the upper casing 11, respectively. This can reduce an effect of the acoustic load. Alternatively, a damping cloth may be provided on the opening 11*h* for controlling sharpness in the minimum resonant frequency.

In the configuration shown in FIGS. 1 and 2, the side portions of the lower casing 10 and the upper casing 11 are upright in the direction perpendicular to the bottom portion of the lower casing 10. However, the present invention is not limited thereto. For example, the side portions of the lower casing 10 and the upper casing 11 may be inclined so as to have a horn shape. Thus, a high-frequency characteristic can be controlled.

(Second Embodiment)

Figure 11:
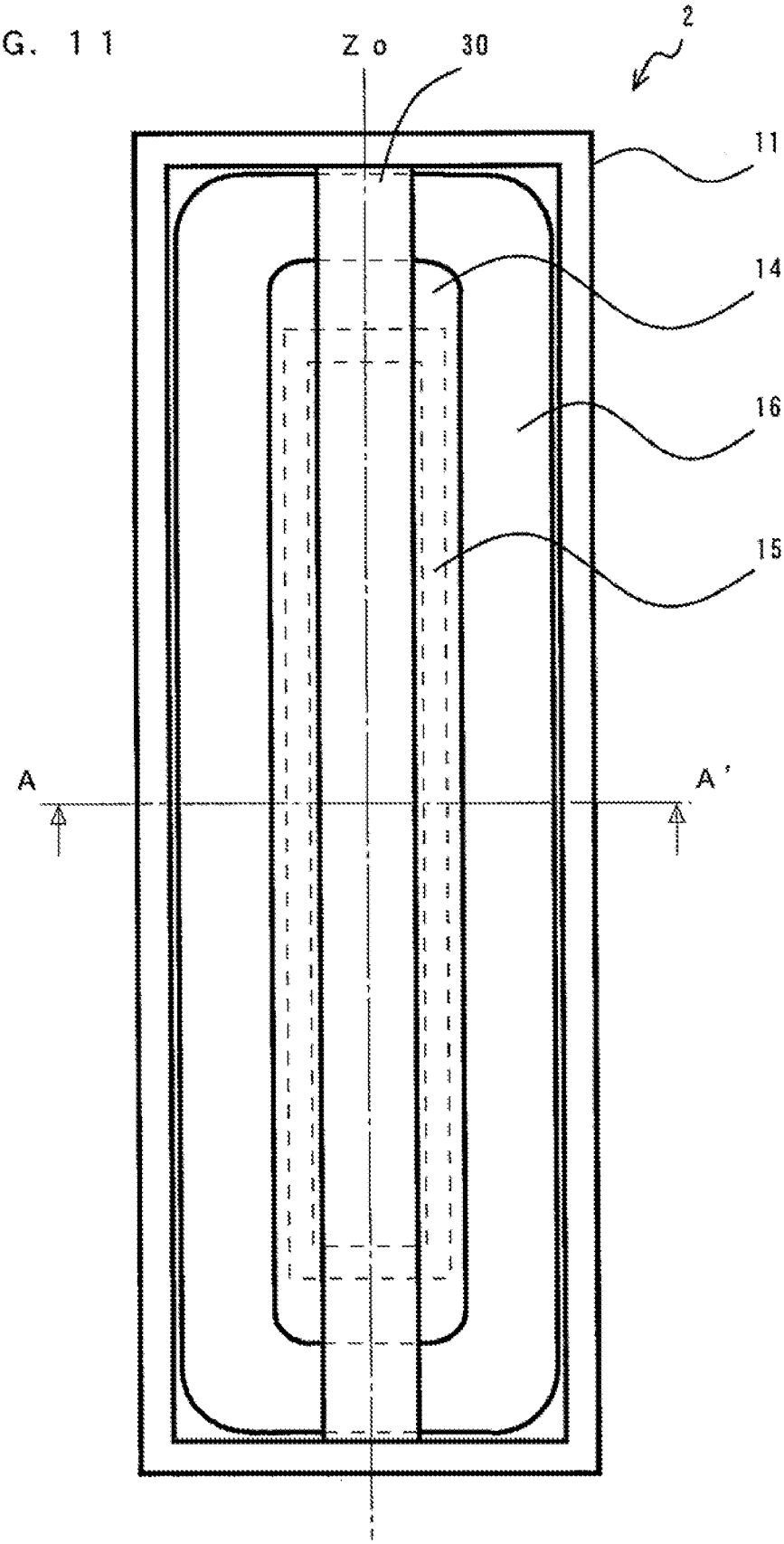
FIG. 11 is a front view of an electro-acoustic transducer 2 according to a second embodiment.
Figure 12:
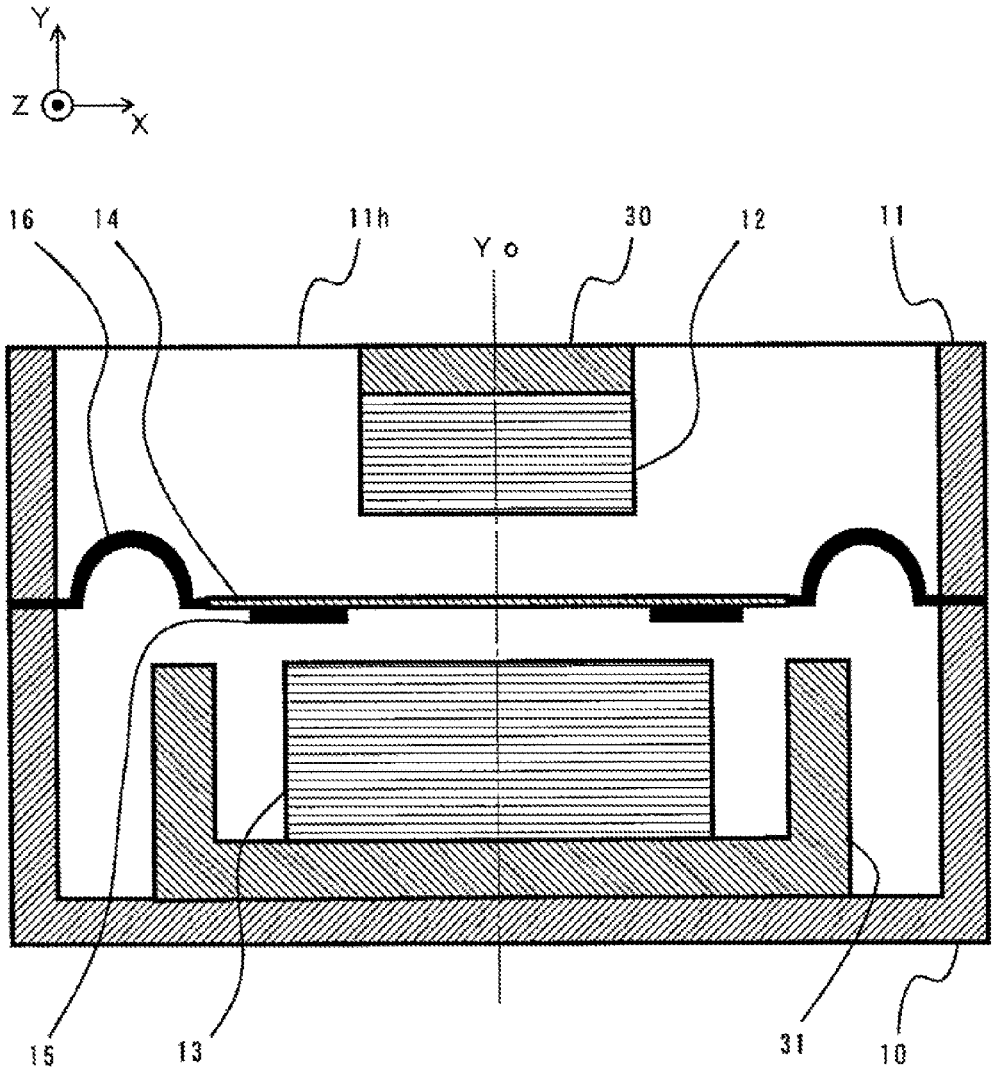
FIG. 12 is a cross-sectional view of the electro-acoustic transducer 2 taken along the line A-A' shown in FIG. 11.

With reference to FIGS. 11 and 12, an electro-acoustic transducer 2 according to a second embodiment of the present invention will be described. FIG. 11 is a front view of the electro-acoustic transducer 2 according to the second embodiment. Lines Zo shown in FIG. 11 and later-described FIG. 13 indicate a center of the electro-acoustic transducer 2 in a left-right direction as viewed toward sheet surfaces thereof. FIG. 12 is a cross-sectional view of the electro-acoustic transducer 2 taken along the line A-A' shown in FIG. 11. Lines Yo shown in FIG. 12 and later-described FIGS. 14 and 15 indicate a central axis of the electro-acoustic transducer 2 which is parallel to a thickness direction of the electro-acoustic transducer 2. It is noted that in FIG. 12 and later-described FIG. 14, as viewed toward sheet surfaces thereof, a left-right direction is an X-axis direction, and its rightward direction is a positive direction. Also, as viewed toward the sheet surfaces, an up-down direction is a Y-axis direction, and its upward direction is a positive direction. Further, a direction perpendicular to the X-axis and Y-axis directions is a Z-axis direction, and a direction directed from the sheet surfaces toward the viewer is a positive direction.

The electro-acoustic transducer 2 according to the present embodiment is different in configuration from the electro-acoustic transducer 1 shown in FIGS. 1 and 2 in that yokes are fixed to the first and second magnets 12 and 13, respectively. In FIGS. 11 and 12, the same elements as those of the electro-acoustic transducer 1 shown in FIGS. 1 and 2 are designated by the same reference characters, and the description thereof will be omitted. The following will describe mainly the differences.

As shown in FIG. 11, a front shape of the electro-acoustic transducer 2 is an elongated shape. As shown in FIG. 12, the electro-acoustic transducer 2 includes a lower casing 10, an upper casing 11, a first magnet 12, a second magnet 13, a diaphragm 14, a drive coil 15, an edge 16, a first yoke 30, and a second yoke 31.

The first yoke 30 has a plate shape, and is formed of magnetic material such as iron, and the like. The first yoke 30 is fixed to an inner surface of the upper casing 11. The first magnet 12 is fixed to a lower surface of the first yoke 30. The first yoke 30 forms a magnetic path in at least a portion around the first magnet 12. The first magnet 12 is supported by the first yoke 30 so as to face the second magnet 13 through the diaphragm 14. The first yoke 30 has the same width in a short side direction thereof (the X-axis direction) as that of the first magnet 12 in a short side direction thereof (the X-axis direction). The first yoke 30 has the same width in a long side direction thereof (the Z-axis direction) as that of the first magnet 12 in a long side direction thereof (the Z-axis direction). The upper casing 11 is formed with an opening 11*h* in a portion of an upper surface thereof, in which the first yoke 30 is not disposed, for emitting sound therethrough. The first yoke 30, the lower casing 10, and the upper casing 11 are combined to form a casing.

The second yoke 31 has a recessed shape, and is formed of magnetic material such as iron, and the like. The second yoke 31 is fixed to an inner bottom surface of the lower casing 10. The second yoke 31 forms a magnetic path in at least a portion around the second magnet 13. The second yoke 31 has a width in a short side direction thereof (the X-axis direction), which is larger than that of the second magnet 13 in a short side direction thereof (the X-axis direction). The second yoke 31 has the same width in a long side direction hereof (the Z-axis direction) as that of the second magnet 13 in a long side direction thereof (the Z-axis direction). The first yoke 30 and the second yoke 31 are disposed so that central axes thereof coincide with the central axis Yo.

The second magnet 13 is fixed to an inner bottom surface of the second yoke 31. As shown in FIG. 12, an upper surface of the second magnet 13 is flush with upper surfaces of side portions of the second yoke 31. In other words, the second yoke 31 is provided so as to surround surfaces of the second magnet 13 other than the surface of the second magnet 13 which faces the diaphragm 14. Between inner side surfaces of the second yoke 31 and side surfaces of the second magnet 13 in the long side direction thereof, a space (a slit) is formed.

The first magnet 12 and the second magnet 13 are disposed so that central axes thereof coincide with the central axis Yo. Upper and lower surfaces of the first magnet 12 and upper and lower surfaces of the second magnet 13 are magnetic pole surfaces each having a magnetic pole. Between the first magnet 12 and the second magnet 13, a magnetic gap is formed. A polarization direction of the first magnet 12 is the Y-axis direction. On the other hand, the second magnet 13 is polarized in the Y-axis direction but in a direction opposite to the polarization direction of the first magnet 12. The first magnet 12 has a width in the short side direction thereof, which is smaller than that of the second magnet 13 in the short side direction thereof. The first yoke 30 has a width in the short side direction thereof, which is smaller than that of the second yoke 31 in the short side direction thereof. Thus, an outer shape of the first magnet 12 is smaller than that of a combination of the second magnet 13 and the second yoke 31.

The following will describe an operation of the electro-acoustic transducer 2 shown in FIGS. 11 and 12. When an alternating current electric signal is inputted to the drive coil 15, a driving force in the up-down direction (the Y-axis direction) is generated in the drive coil 15 by a magnetic flux in the X-axis direction. The driving force vibrates the diaphragm 14 in the up-down direction, thereby emitting sound from the diaphragm 14. The sound emitted from the diaphragm 14 is released through the opening 11*h* to the outside.

The first yoke 30 is fixed to the first magnet 12. Thus, a magnetic flux emitted from the lower surface of the first magnet 12 is guided to the first yoke 30. In other words, by providing the first yoke 30, a magnetic path, through which the magnetic flux emitted from the lower surface of the first magnet 12 passes when reaching the first yoke 30, is shortened in length. Similarly, the second yoke 31 is fixed to the second magnet 13. Thus, a magnetic flux emitted from the upper surface of the second magnet 13 is guided to the second yoke 31. In other words, by providing the second yoke 31, a magnetic path, through which the magnetic flux emitted from the lower surface of the second magnet 13 passes when reaching the second yoke 31, is shortened in length. Thus, a magnetic operating point becomes high, and a magnetic flux density in the magnetic gap is increased. As described above, by providing the yokes in the vicinities of the first and second magnets 12 and 13, the magnetic fluxes emitted from the first and second magnets 12 and 13 are converged to the yokes, respectively. As a result, the driving force generated in the drive coil 15 is increased further, and the sound pressure level of the reproduced sound can be raised further.

It is noted that preferably, the drive coil 15 may be provided in a position which causes the highest magnetic flux density in the magnetic gap. In other words, preferably, the drive coil 15 may be disposed in a position which includes a line connecting an outer periphery of the first magnet 12 to an outer periphery of the second yoke 31. As a result, a magnetic flux density at the position of the drive coil 15 becomes the highest magnetic flux density. Thus, the driving force proportional to the magnetic flux density is increased, thereby increasing the sound pressure of the reproduced sound. For example, the width of the second magnet 13 in the short side direction thereof is set to 4 mm, and the height thereof is set to 2 mm. The second magnet 13 is constructed of the neodymium magnet. In this case, the magnetic flux density at the position of the drive coil 15 is 1.5 times as large as that in the case where there are not the first and second yokes 30 and 31. If the magnetic flux density is converted into the sound pressure level, the sound pressure level is increased by 3.5 dB. In addition, by providing the first and second yokes 30 and 31, the magnetic flux is prevented from leaking to outside the electro-acoustic transducer 2. Further, the outer shape of the first magnet 12 is smaller than that of the second magnet 13, and the width of the first yoke 30 in the short side direction thereof is the same as that of the first magnet 12 in the direction short side thereof. Thus, an acoustic load with respect to the diaphragm 14 becomes small, thereby suppressing an effect on a sound pressure frequency characteristic.

As described above, in the electro-acoustic transducer 2 according to the present embodiment, the yokes are provided in the vicinities of the first and second magnets 12 and 13, respectively. Thus, the magnetic fluxes emitted from the first and second magnets 12 and 13 are converged to the yokes, respectively. As a result, the driving force generated in the drive coil 15 is increased further, and the sound pressure level of the reproduced sound is raised further.

Figure 13:
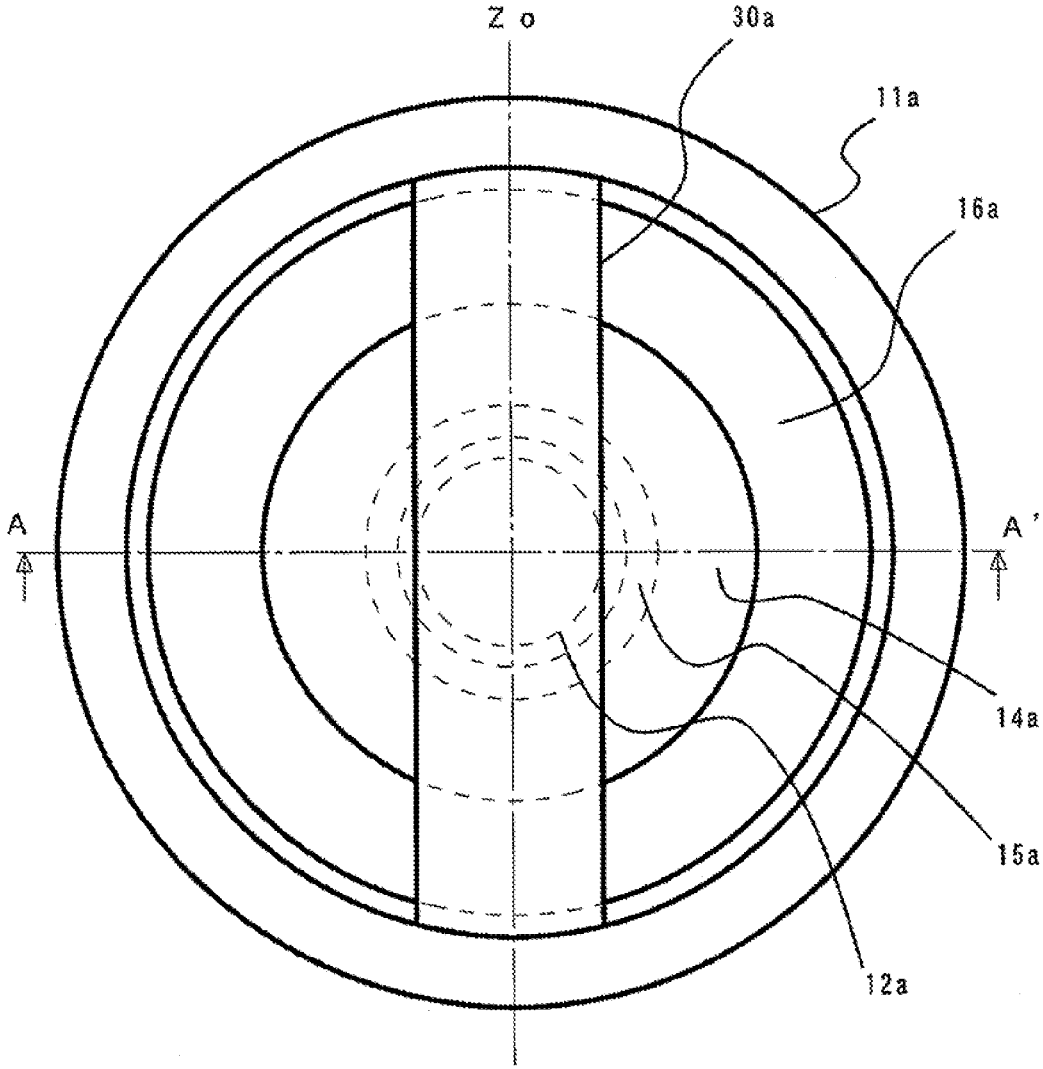
FIG. 13 is a front view of a circular-shaped electro-acoustic transducer 2.
Figure 14:
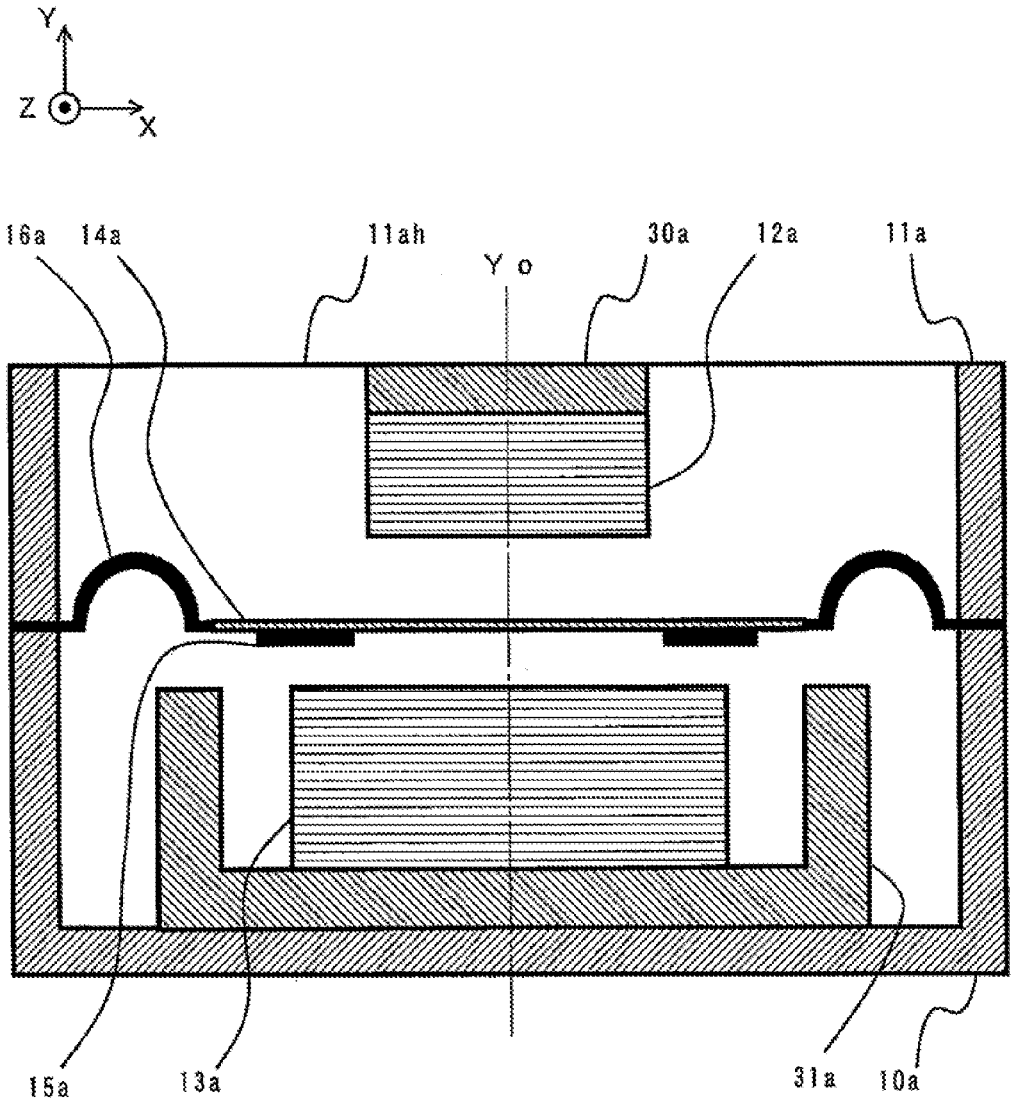
FIG. 14 is a cross-sectional view of the electro-acoustic transducer 2 taken along the line A-A' shown in FIG. 13.

In the configuration shown in FIGS. 11 and 12, the front shape of the electro-acoustic transducer 2 is the elongated shape, and a shape of each component such as the first magnet 12, the second magnet 13, and the like is a shape in accordance with the elongated shape. However, the present invention is not limited thereto. For example, as shown in FIGS. 13 and 14, the front shape of the electro-acoustic transducer 2 may be a circular shape, and the shape of each component such as the first magnet 12, the second magnet 13, and the like may be a shape in accordance with the circular shape. FIG. 13 is a front view of the circular-shaped electro-acoustic transducer 2. FIG. 14 is a cross-sectional view of the electro-acoustic transducer 2 taken along the line A-A' shown in FIG. 13. In the electro-acoustic transducer 2 shown in FIGS. 13 and 14, the lower casing 10 and the upper casing 11 of the electro-acoustic transducer 2 shown in FIGS. 11 and 12, which have the elongated shape, are replaced with a circular-shaped lower casing 10*a* and a circular-shaped upper casing 11*a*. Similarly, the first and second magnets 12 and 13, which are constructed of the elongated rectangular parallelepipeds, are replaced with first and second magnets 12*a* and 13*a* which are constructed of cylindrical bodies. In addition, the diaphragm 14 having the elongated shape is replaced with a circular-shaped diaphragm 14*a*, the drive coil 15 having the elongated rectangular shape is replaced with a circular-shaped drive coil 15*a*, and the edge 16 which is formed in an elongated annular shape is replaced with an edge 16*a* which is formed in a circular and annular shape. Further, the first yoke 30 is replaced with a differently shaped first yoke 30*a*, and the second yoke 31 having the recessed shape is replaced with a second yoke 31*a* having a cylindrical shape with a bottom surface. The electro-acoustic transducer 2 shown in FIGS. 13 and 14 has a configuration, in which, in the electro-acoustic transducer 1 shown in FIGS. 7 and 8, the supporting member 20 is replaced with the first yoke 30*a* and the second yoke 31*a* is further provided.

As shown in FIG. 14, the lower casing 10*a* is combined with the first yoke 30*a* and the upper casing 11*a* to form a casing in which a surface in the Y-axis positive direction is opened. The first yoke 30*a* is fixed to an inner surface of the upper casing 11*a*. The first magnet 12*a* is fixed at an upper surface thereof to the first yoke 30*a*. Thus, the first magnet 12*a* is supported by the first yoke 30*a* so as to face the second magnet 12*a* through the diaphragm 14*a*. The upper casing 11*a* is formed with an opening 11*ah* in a portion of an upper surface thereof, in which the first yoke 30*a* is not disposed, for emitting sound therethrough. The second magnet 13*a* is fixed to an inner bottom surface of the second yoke 31*a*. The first magnet 12*a* and the second magnet 13*a* are disposed so that central axes thereof coincide with the central axis Yo. A lower surface of the first magnet 12*a* and an upper surface of the second magnet 13*a* are magnetic pole surfaces each having a magnetic pole. Between the lower surface of the first magnet 12*a* and the upper surface of the second magnet 13*a*, a magnetic gap is formed. A polarization direction of the first magnet 12*a* is the Y-axis direction. On the other hand, the second magnet 13*a* is polarized in the Y-axis direction but in a direction opposite to the polarization direction of the first magnet 12*a*. The first magnet 12*a* has an outer diameter which is the same as that of the first yoke 30*a* and smaller than that of the second magnet 13*a*. The second yoke 31*a* has an outer diameter which is larger than that of the second magnet 13*a*.

The diaphragm 14*a* is disposed so as to face each of the first and second magnets 12*a* and 13*a*. An outer peripheral portion of the diaphragm 14*a* is fixed to an inner peripheral portion of the edge 16*a*. An outer peripheral portion of the edge 16*a* is fixed between an upper surface of a side portion of the lower casing 10*a* and a lower surface of a side portion of the upper casing 11*a*. The edge 16*a* supports the diaphragm 14*a* so as to allow the diaphragm 14*a* to vibrate in the Y-axis direction. The drive coil 15*a* is provided on the diaphragm 14*a* so as to be located in the magnetic gap formed by the first and second magnets 12*a* and 13*a*. It is noted that when the drive coil 15*a* is provided in a position which includes a line connecting an outer periphery of the first magnet 12*a* to an outer periphery of the second yoke 31*a*, the sound pressure level of the reproduced sound can be maximized.

Alternatively, for example, the front shape of the electro-acoustic transducer 2 may be an elliptical shape, a rectangular shape, or a track shape. With this, the shape of each component such as the first magnet 12, the second magnet 13, and the like may be a shape in accordance with the front shape of the electro-acoustic transducer 2.

Figure 15A:
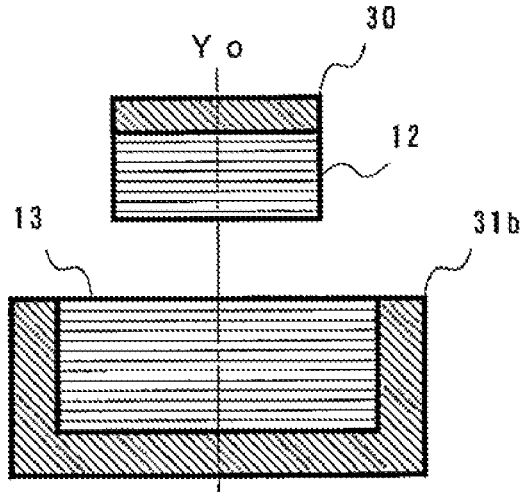
FIG. 15A is a view showing a configuration when a second yoke 31*b*, by which a slit is not formed, is used.
Figure 15B:
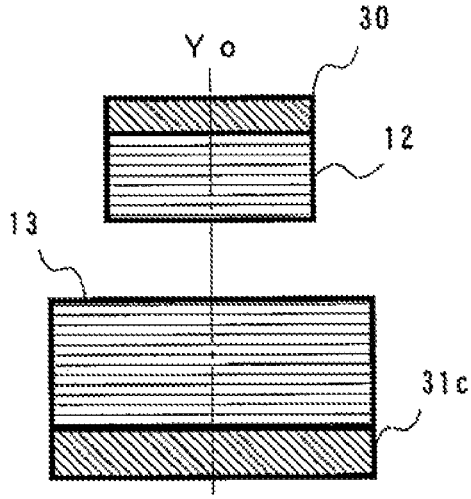
FIG. 15B is a view showing a configuration when a plate-shaped second yoke 31*c* is used.
Figure 15C:
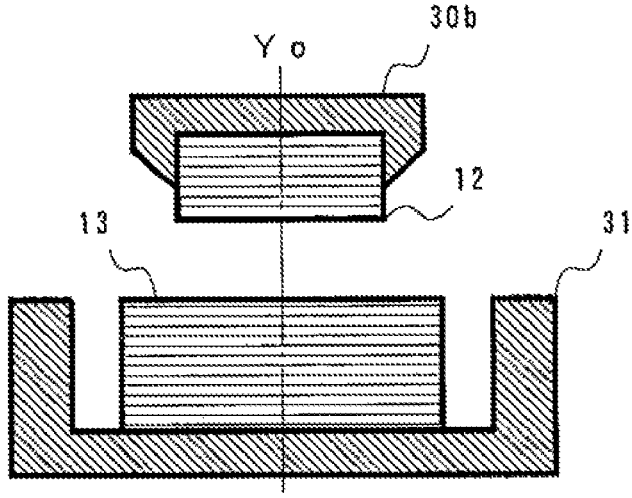
FIG. 15C is a view showing a configuration when a first yoke 30*b* is used.

In the configuration shown in FIGS. 11 and 12, the slit is formed between the inner side surfaces of the second yoke 31 and the side surfaces of the second magnet 13 in the long side direction thereof. However, as shown in FIG. 15A, a second yoke 31*b* having a size which does not allow formation of a slit may be used in place of the second yoke 31. FIG. 15A is a view showing a configuration when the second yoke 31*b*, by which a slit is not formed, is used. By eliminating the slit, an overall outer shape of the electro-acoustic transducer 2 can be made small. Alternatively, as shown in FIG. 15B, a plate-shaped second yoke 31*c* may be used in place of the second yoke 31. FIG. 15B is a view showing a configuration when the plate-shaped second yoke 31*c* is used. Still alternatively, as shown in FIG. 15C, a first yoke 30*b* may be used in place of the first yoke 30. FIG. 15C is a view showing a configuration when the first yoke 30*b* is used. A first yoke 30*b* has a shape so as to surround the upper surface and parts of the side surfaces of the first magnet 12. A part of the first yoke 30*b* which surrounds the side surfaces of the first magnet 12 has an outer shape which is tapered from the first magnet 12 toward the second magnet 13. By such a shape, the effect by the acoustic load can be reduced. As shown in FIGS. 15A to 15C, the second yokes 31, 31*b*, and 31*c* are not disposed on the upper surface of the second magnet 13. In other words, the second yokes 31, 31*b*, and 31*c* are provided so as to surround surfaces of the second magnet 13 other than the surface of the second magnet 13 which faces the diaphragm 14.

In the configuration shown in FIG. 12, the upper surface of the second magnet 13 is flush with the upper surfaces of the side portions of the second yoke 31. However, depending on the shape and a maximum amplitude value of the diaphragm 14, a step may be provided so that the upper surface of the second magnet 13 is not flush with the upper surfaces of the side portions of the second yoke 31.

In the configuration shown in FIGS. 11 and 12, the first yoke 30 and the upper casing 11 are provided independently of each other, but may be integral with each other. Alternatively, the second yoke 31 and the lower casing 10 are provided independently of each other, but may be integral with each other. Thus, a number of components can be reduced.

(Third Embodiment)

Figure 16:
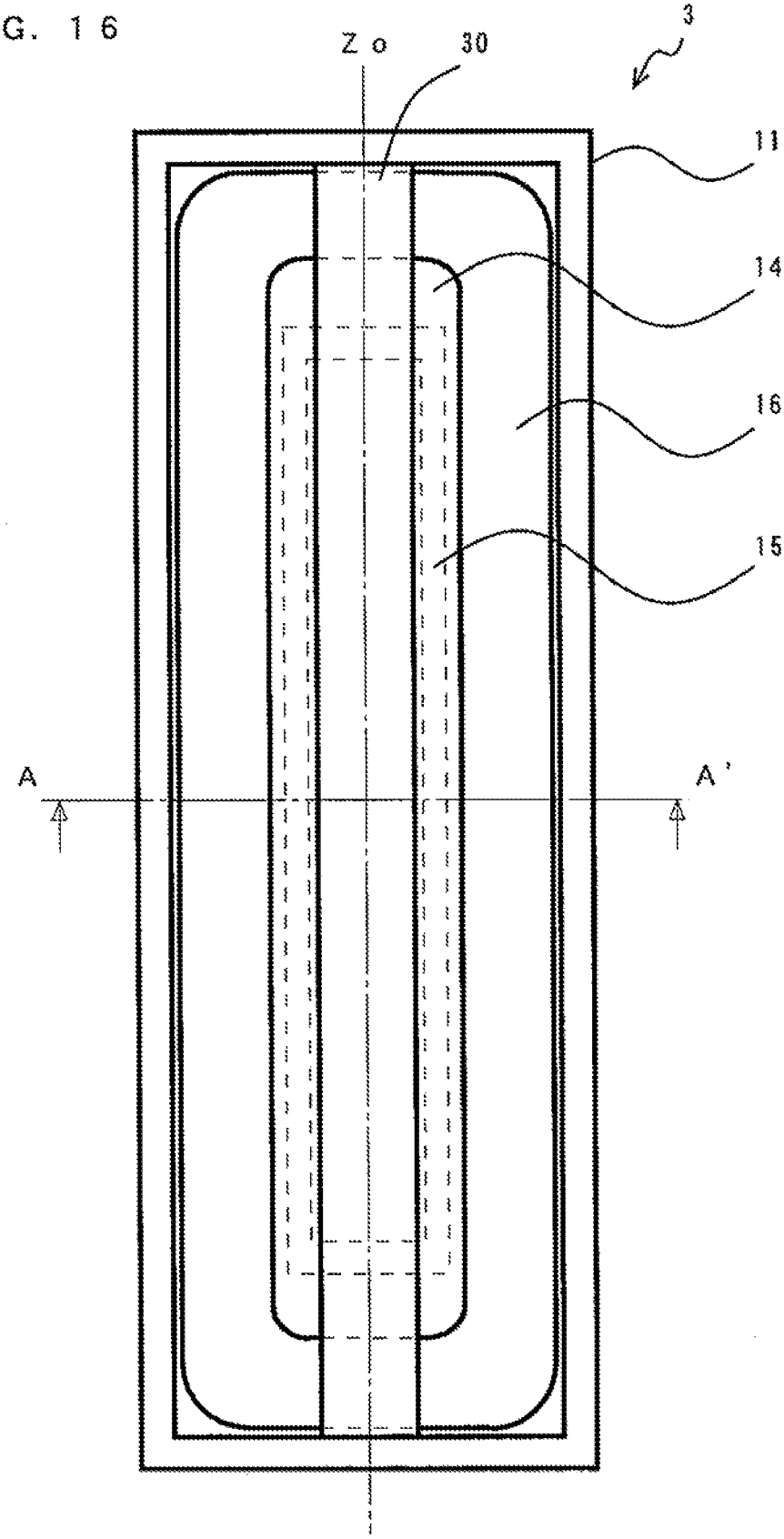
FIG. 16 is a front view of an electro-acoustic transducer 3 according to a third embodiment.
Figure 17:
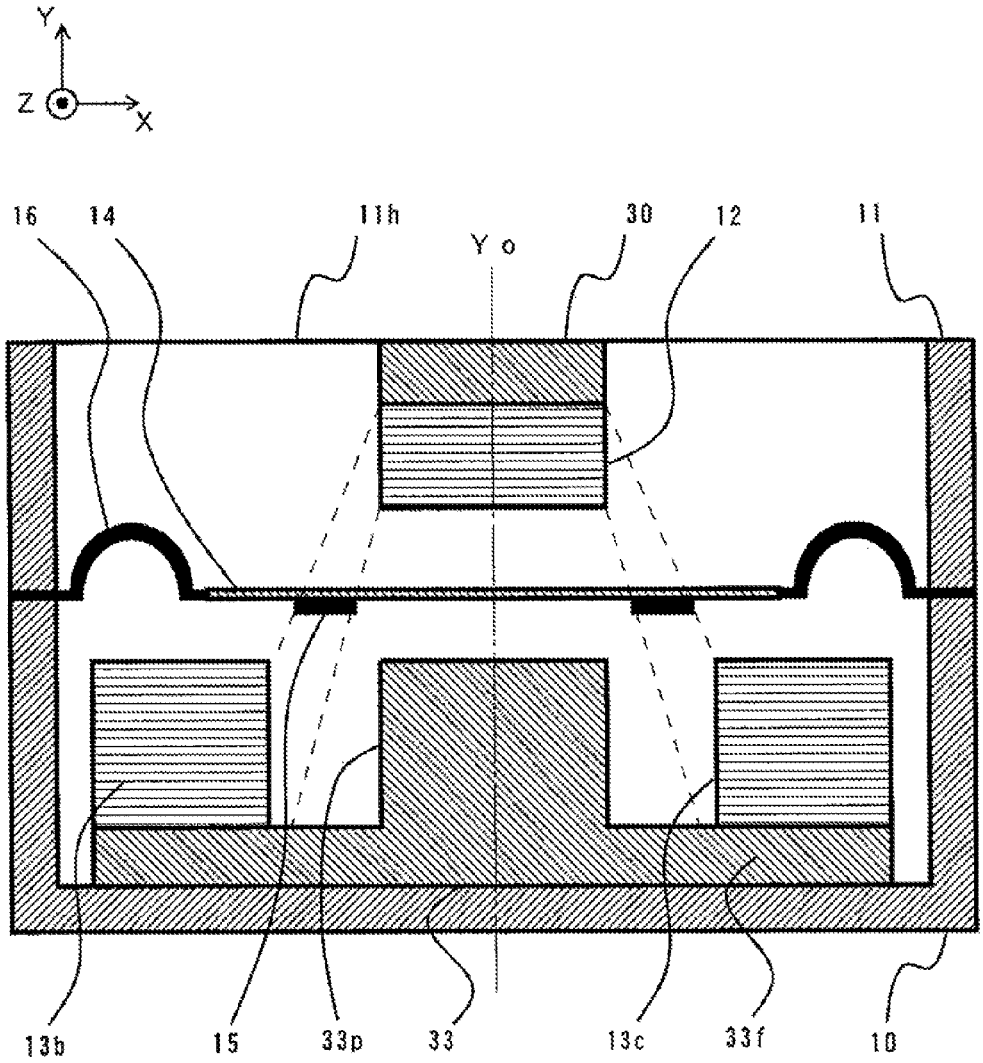
FIG. 17 is a cross-sectional view of the electro-acoustic transducer 3 taken along the line A-A' shown in FIG. 16.

With reference to FIGS. 16 and 17, an electro-acoustic transducer 3 according to a third embodiment of the present invention will be described. FIG. 16 is a front view of the electro-acoustic transducer 3 according to the third embodiment. Lines Zo shown in FIG. 16 and later-described FIGS. 18 and 20 indicate a central axis of the electro-acoustic transducer 3 in a left-right direction. FIG. 17 is a cross-sectional view of the electro-acoustic transducer 3 taken along the line A-A' shown in FIG. 16. Lines Yo shown in FIG. 17 and later-described FIGS. 18, 19, 21, and 22 indicate a central axis of the electro-acoustic transducer 3 which is parallel to a thickness direction of the electro-acoustic transducer 3. It is noted that in FIG. 17 and later-described FIGS. 18, 19, 21, and 22, as viewed toward sheet surfaces thereof, a left-right direction is an X-axis direction, and its rightward direction is a positive direction. Also, as viewed toward the sheet surfaces, an up-down direction is a Y-axis direction, and its upward direction is a positive direction. Further, a direction perpendicular to the X-axis and Y-axis directions is a Z-axis direction, and a direction directed from the sheet surfaces toward a viewer is a positive direction. Further, a direction perpendicular to the X-axis and Y-axis directions is a Z-axis direction, and a direction directed from the sheet surfaces towards a viewer is a positive direction.

The electro-acoustic transducer 3 according to the present embodiment is different in configuration from the electro-acoustic transducer 2 shown in FIGS. 11 and 12 in that the second yoke 31 is replaced with a third yoke 33, and in that the second magnet 13 is replaced with second magnets 13*b* and 13*c*. Thus, the other components are designated by the same reference characters as those shown in FIGS. 11 and 12, and the description thereof will be omitted. The following will describe mainly the differences.

As shown in FIG. 16, a front shape of the electro-acoustic transducer 3 is an elongated shape. As shown in FIG. 17, the electro-acoustic transducer 3 includes a lower casing 10, an upper casing 11, a first magnet 12, the second magnets 13*b* and 13*c*, a diaphragm 14, a drive coil 15, an edge 16, a first yoke 30, and the third yoke 33.

The third yoke 33 is formed of magnetic material such as iron, and the like. The third yoke 33 has a shape in which a center pole 33*p* having a rectangular parallelepiped shape is formed on a center of a plate-shaped plate section 33*f*. The third yoke 33 is fixed to an inner bottom surface of the lower casing 10 so that a central axis of the center pole 33*p* coincides with the central axis Yo. The third yoke 33 is also fixed so that long sides of the center pole 33*p* are parallel to a long side portion of the drive coil 15. Thus, a central axis of the first magnet 12 coincides with that of the center pole 33*p*.

The second magnets 13*b* and 13*c* are constructed of elongated rectangular parallelepipeds, respectively. As each of the second magnets 13*b* and 13*c*, for example, a neodymium magnet having an energy product of 38 MGOe, and the like is used. The second magnet 13*b* is fixed on a portion of the plate section 33*f* which exists in a leftward direction (in a X-axis negative direction with respect to the central axis Yo). The second magnet 13*c* is fixed on a portion of the plate section 33*f* which exists in the rightward direction (in the X-axis positive direction with respect to the central axis Yo). Between a left side surface of the center pole 33*p* and a right side surface of the second magnet 13*b*, and between a right side surface of the center pole 33*p* and a left side surface of the second magnet 13*c*, magnetic gaps are formed, respectively.

Figure 18:
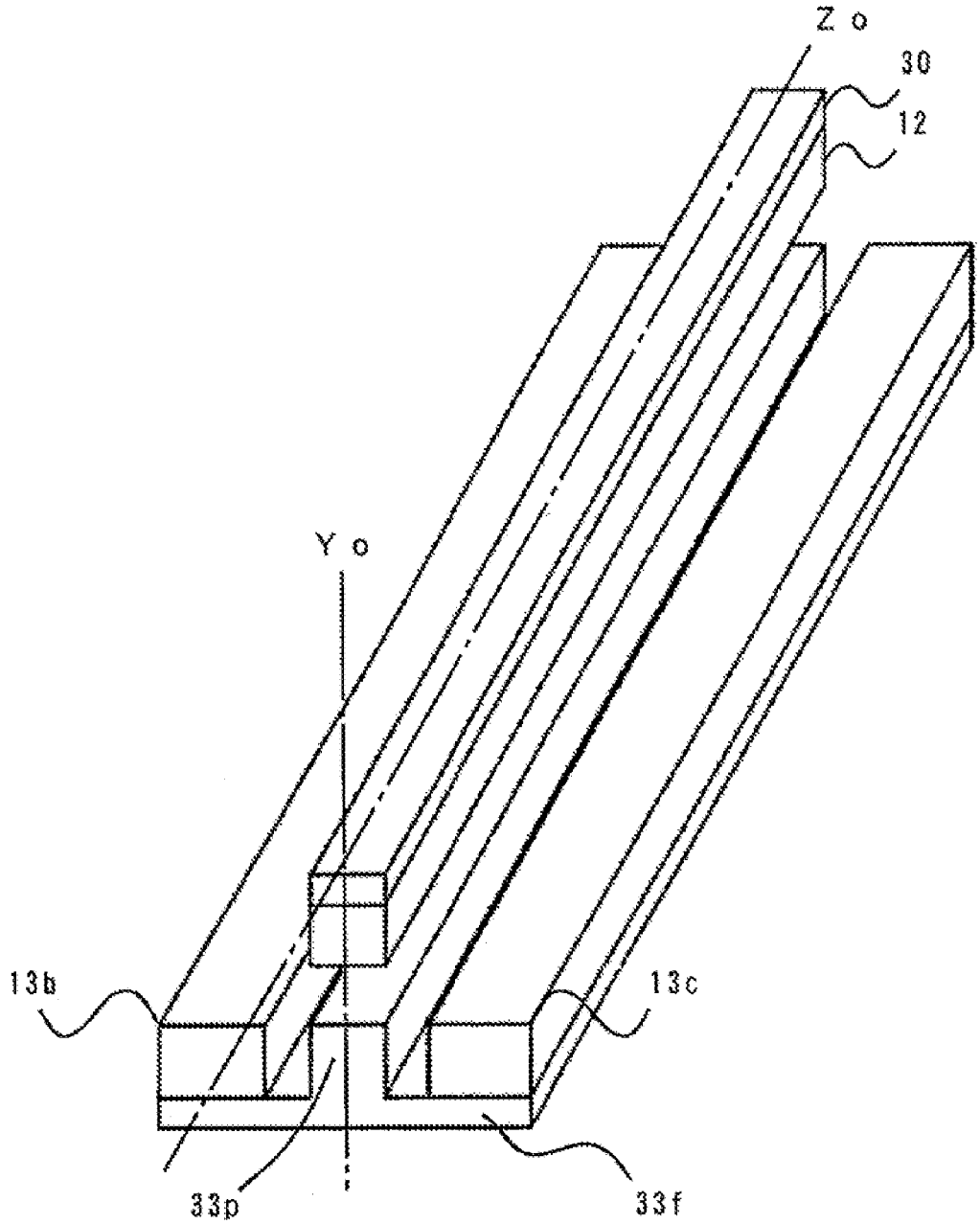
FIG. 18 is a perspective view showing only a magnetic circuit of the electro-acoustic transducer 3.

FIG. 18 is a perspective view showing only a magnetic circuit of the electro-acoustic transducer 3. As shown in FIG. 18, a lower surface of the first magnet 12 faces only an upper surface of the center pole 33*p*. The second magnets 13*b* and 13*c* are fixed to the third yoke 33 so as to surround long side surfaces of the center pole 33*p*. The third yoke 33, the second magnets 13*b* and 13*c*, the first yoke 30, and the first magnet 12 have the same width in the long side direction thereof. The first yoke 30 and the first magnet 12 each have a width in the direction short side thereof, which is smaller than that of a combination of the third yoke 33 and the second magnets 13*b* and 13*c* in a short side direction thereof.

Here, polarization directions of the first magnet 12 and the second magnets 13*b* and 13*c* will be described. The polarization directions of the first magnet 12 and the second magnets 13*b* and 13*c* are the Y-axis direction, and the same as each other. For example, when a magnetic pole of the lower surface of the first magnet 12 is a north pole, magnetic poles of the upper surfaces of the second magnets 13*b* and 13*c* are south poles. In other words, the magnetic poles of the upper surfaces of the second magnets 13*b* and 13*c* are poles which are opposite to the magnetic pole of the lower surface of the first magnet 12.

Figure 19:
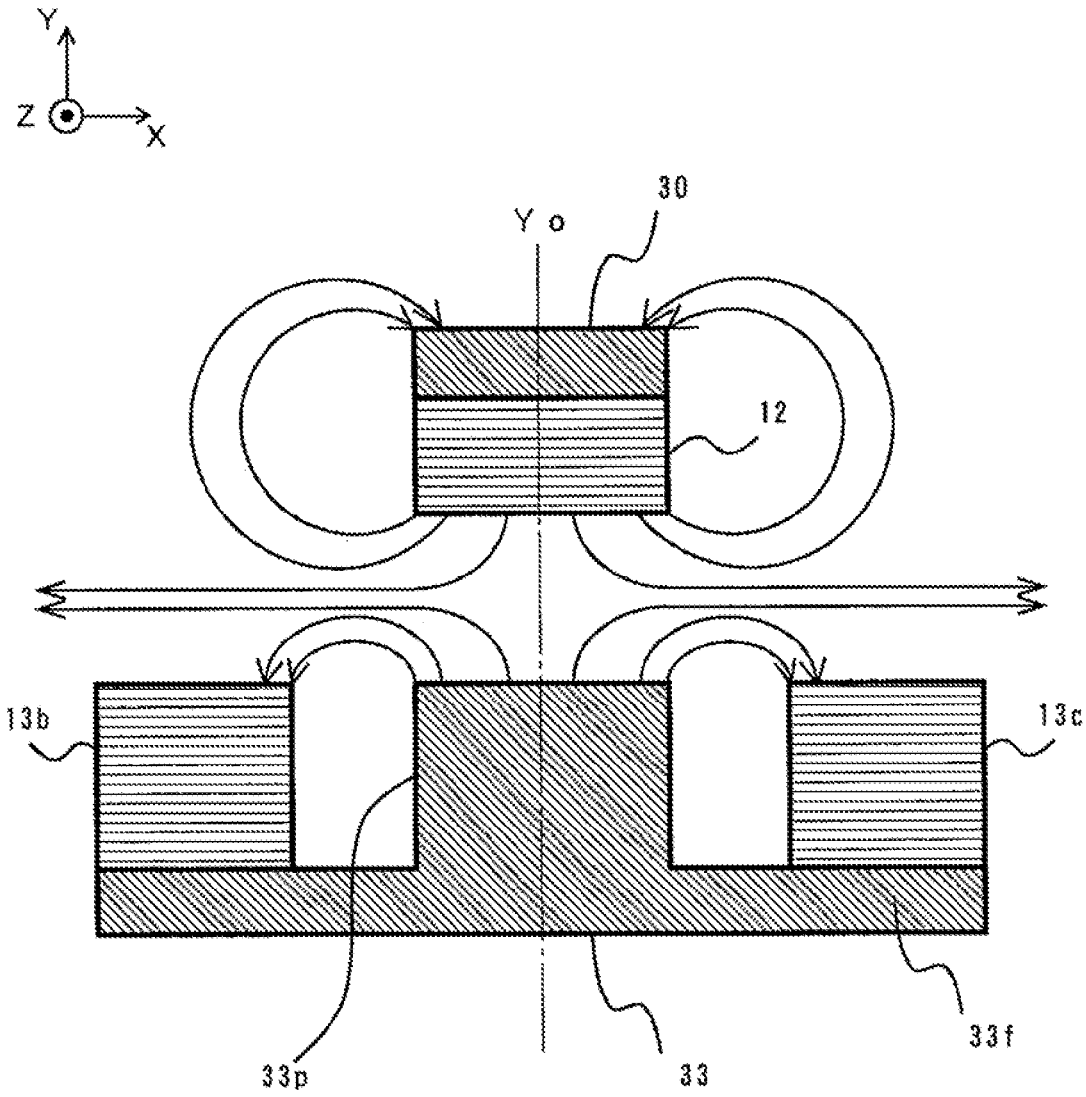
FIG. 19 is a view showing a static magnetic field, which is formed in the electro-acoustic transducer 3, by using vectors of magnetic fluxes.

The following will describe an operation of the electro-acoustic transducer 3 shown in FIGS. 16 and 17. First, with reference to FIG. 19, a static magnetic field, which is formed in the electro-acoustic transducer 3 when an alternating current electric signal is not inputted to the drive coil 15, will be described. FIG. 19 is a view showing the static magnetic field, which is formed in the electro-acoustic transducer 3, by using vectors of magnetic fluxes. In FIG. 19, an arrow indicates a vector of a magnetic flux, a direction of the arrow indicates a direction of the magnetic flux. It is noted that in FIG. 19, the magnetic poles of the upper surfaces of the second magnets 13*b* and 13*c* are south poles, and the magnetic pole of the lower surface of the first magnet 12 is a north pole.

The first magnet 12 and the second magnets 13*b* and 13*c* are polarized in the same direction. A magnetic flux emitted from a lower surface of the second magnet 13*b* passes through the plate section 33*f* of the third yoke 33 toward the upper surface of the center pole 33*p*. A magnetic flux emitted from the lower surface of the second magnet 13*c* passes through the plate section 33*f* of the third yoke 33 toward the upper surface of the center pole 33*p*. Thus, the magnetic fluxes emitted from the lower surfaces of the second magnets 13*b* and 13*c* are emitted from the upper surface of the center pole 33*p*. The directions of the magnetic fluxes emitted from the upper surface of the center pole 33*p* are a vertical, and upward direction (the Y-axis positive direction). Here, since a surface, from which a magnetic flux is emitted, indicates a north pole, a magnetic pole of the upper surface of the center pole 33*p* is a north pole. In other words, the magnetic pole of the upper surface of the center pole 33*p*, which faces the first magnet 12, has the same polarity as that of the lower surface of the first magnet 12.

The magnetic fluxes emitted from the upper surface of the center pole 33*p* repel the magnetic flux emitted from the lower surface of the first magnet 12. Thus, as shown in FIG. 19, the magnetic fluxes emitted from the first magnet 12 and the center pole 33*p* bend in a direction perpendicular to the vibration direction of the diaphragm 14 (in the X-axis direction). The magnetic fluxes in the X-axis direction become magnetic fluxes proportional to the driving force.

In the static magnetic field shown in FIG. 19, a position where a magnetic flux density is high is a position in the magnetic gaps which are in contact with the side surfaces of the center pole 33*p*, respectively. Further, in the magnetic gaps, a position where the magnetic flux is the highest is in a space formed by linearly connecting a right side surface of the second magnet 13*b* to a left side surface of the first magnet 12. This space is indicated by two dotted lines which exist on the left side from the central axis Yo in FIG. 17. Further, another position where the magnetic flux is the highest exists in a space formed by linearly connecting a left side surface of the second magnet 13*c* to a right side surface of the first magnet 12. This space is indicated by two dotted lines which exist on the right side from the central axis Yo in FIG. 17. Thus, when the long side portion of the drive coil 15 is disposed in theses spaces, the sound pressure level of the reproduced sound can be maximized.

As described above, in the electro-acoustic transducer 3 according to the present embodiment, the second magnets 13*b* and 13*c* and the third yoke 33 are disposed in a position opposite to the sound emission surface side. Here, the position opposite to the sound emission surface side is a position which does not affect disturbance of the sound pressure frequency characteristic by the acoustic load. Thus, an outer shape of the magnet, which is disposed in the position opposite to the sound emission surface side, can be made large enough. Further, a configuration formed by the second magnets 13*b* and 13*c* and the third yoke 33 has a large outer shape, but can ensure a sufficient area of the magnet. Thus, by disposing such a configuration in the position opposite to the sound emission surface side, the magnetic flux density can be sufficiently increased without occurrence of deterioration of a sound quality due to the acoustic load.

Further, in the electro-acoustic transducer 3 according to the present embodiment, the position where the magnetic flux density is high is the position in the magnetic gaps which are in contact with the side surfaces of the center pole 33*p*, respectively. Thus, a high magnetic flux density can be ensured without changing the position of the drive coil 15.

Further, in the electro-acoustic transducer 3 according to the present embodiment, the drive coil 15 may be disposed in a space between the first magnet 12 and the second magnets 13*b* and 13*c*. In other words, unlike a conventional electro-dynamic electro-acoustic transducer, a voice coil does not need to be inserted in the magnetic gap. Thus, a winding width of the drive coil 15 does not need to be even, and degree of freedom in designing is increased concerning an aspect ratio of the drive coil 15. As a result, an electro-acoustic transducer can be easily realized, which has an elliptical shape or an elongated shape having a large aspect ratio.

Figure 20:
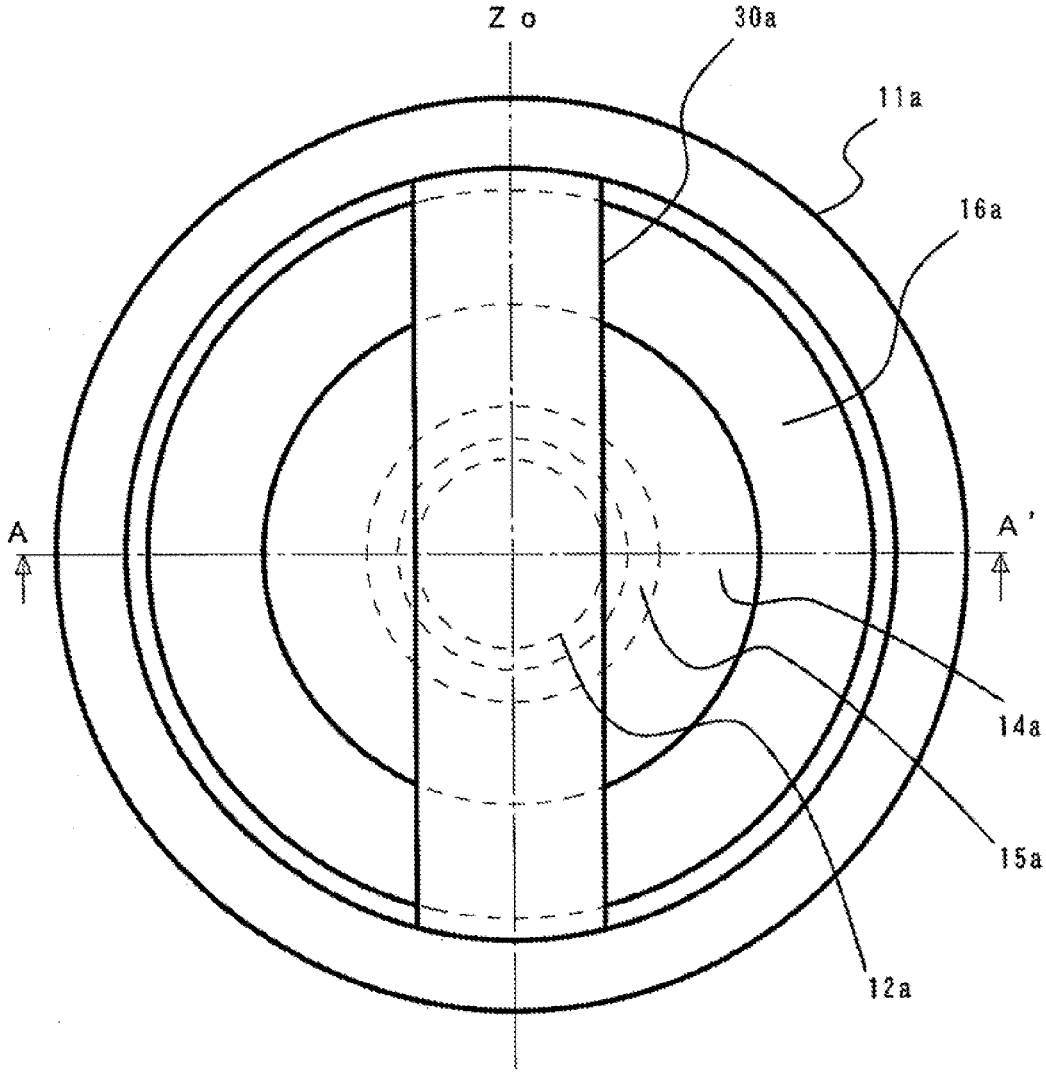
FIG. 20 is a front view of a circular-shaped electro-acoustic transducer 3.
Figure 21:
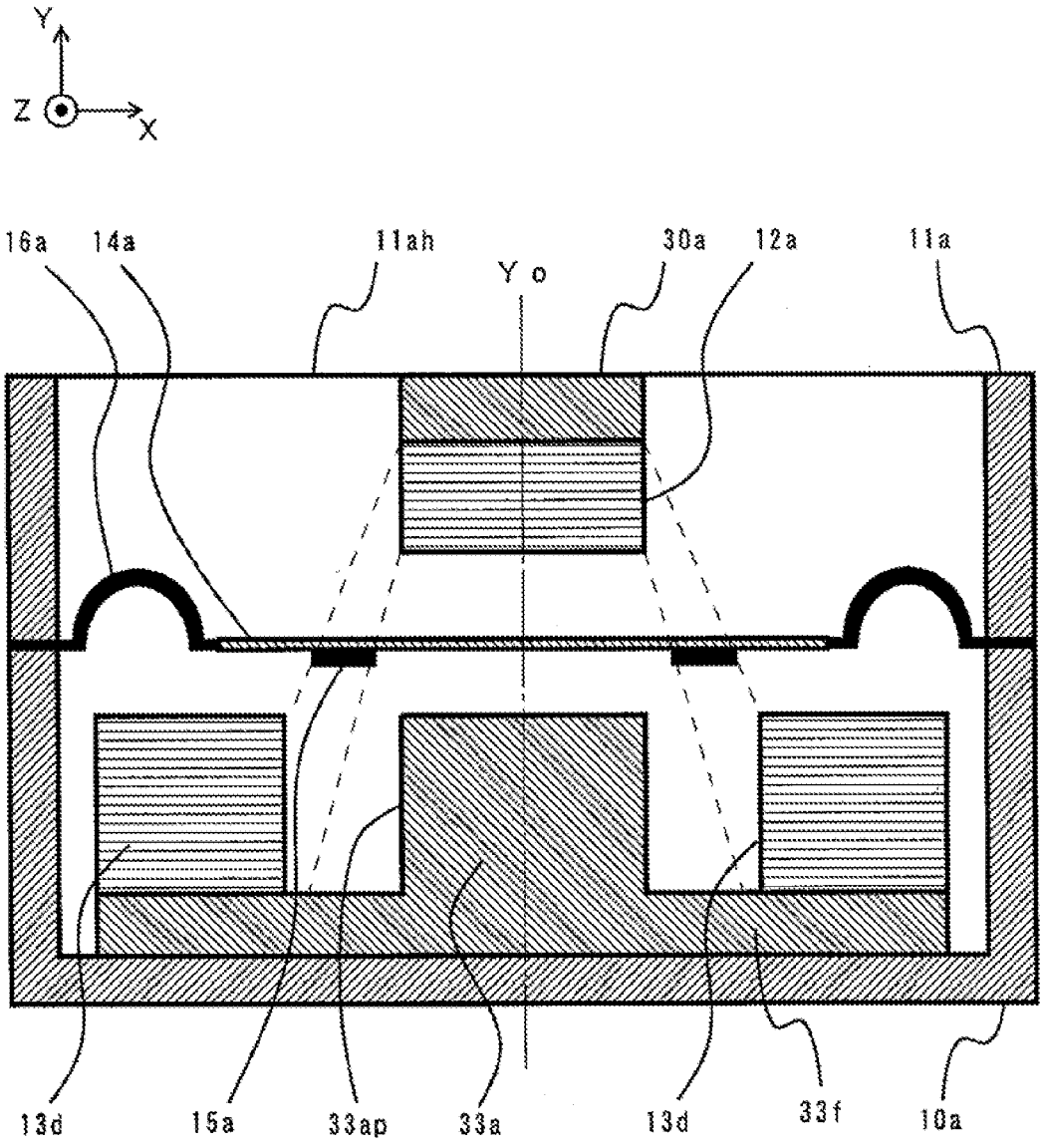
FIG. 21 is a cross-sectional view of the electro-acoustic transducer 3 taken along the line A-A' shown in FIG. 20.

In the configuration shown in FIGS. 16 and 17, the front shape of the electro-acoustic transducer 3 is the elongated shape, and a shape of each component such as the first magnet 12, the second magnet 13*b*, and the like is a shape in accordance with the elongated shape. However, the present invention is not limited thereto. For example, as shown in FIGS. 20 and 21, the front shape of the electro-acoustic transducer 3 may be a circular-shaped, and the shape of each component such as the first magnet 12, the second magnet 13*b*, and the like may be a shape in accordance with the circular-shaped. FIG. 20 is a front view of the circular-shaped electro-acoustic transducer 3. FIG. 21 is a cross-sectional view of the electro-acoustic transducer 3 taken along the line A-A' shown in FIG. 20. In the electro-acoustic transducer 3 shown in FIGS. 20 and 21, the lower casing 10 and the upper casing 11 of the electro-acoustic transducer 3 shown in FIGS. 16 and 17, which have the elongated shape, are replaced with a circular-shaped lower casing 10*a* and a circular-shaped upper casing 11*a*, respectively. Similarly, the first magnet 12, which is constructed of the elongated rectangular parallelepiped, is replaced with a first magnet 12*a* which is constructed of a cylindrical body. Also, the second magnets 13*b* and 13*c*, which are constructed of the elongated rectangular parallelepipeds, are replaced with a second magnet 13*d* which is a circular and annular body. In addition, the diaphragm 14 having the elongated shape is replaced with a circular-shaped diaphragm 14*a*, the drive coil 15 having the elongated rectangular shape is replaced with a circular-shaped drive coil 15*a*, and the edge 16 which is formed in an elongated annular shape is replaced with an edge 16*a* which is formed in a circular and annular shape. Further, the first yoke 30 is replaced with a differently shaped first yoke 30*a*, and the third yoke 33 having the shape shown in FIG. 18 is replaced with a third yoke 33 which is formed at a center thereof with a cylindrical-shaped center pole 33*ap*. The electro-acoustic transducer 3 shown in FIGS. 20 and 21 has a configuration in which, in the electro-acoustic transducer 1 shown in FIGS. 7 and 8, the supporting member 20 is replaced with the first yoke 30*a* and the second magnet 13 is replaced with the second magnet 13*d* and the third yoke 33*a*.

As shown in FIG. 21, the lower casing 10*a* is combined with the first yoke 30*a* and the upper casing 11*a* to form a casing in which a surface in the Y-axis positive direction is opened. The first yoke 30*a* is fixed to an inner surface of the upper casing 11*a*. The first magnet 12*a* is fixed to the first yoke 30*a*. Thus, the first magnet 12*a* is supported by the first yoke 30*a* so as to face the second magnet 13*d* through the diaphragm 14*a*. The upper casing 11*a* is formed with an opening 11*ah* in a portion of an upper surface thereof, in which the first yoke 30*a* is not disposed, for emitting sound therethrough.

The second magnet 13*d* is the circular and annular body, and fixed to a plate section 33*af* of the third yoke 33*a* so that the cylindrical-shaped center pole 33*ap* is located in a void formed at a center of the second magnet 13*d*. The first magnet 12*a* and the second magnet 13*d* are disposed so that central axes thereof coincide with the central axis Yo. A polarization direction of the first magnet 12*a* and a polarization direction of the second magnet 13*d* are the Y-axis direction, and the same as each other. The first magnet 12*a* has an outer diameter which is smaller than an outermost diameter of the second magnet 13*d*. The first magnet 12*a* faces only the center pole 33*ap* through the diaphragm 14.

The diaphragm 14*a* is disposed in a position so as to face each of the first magnet 12*a* and the second magnet 13*d*. An outer peripheral portion of the diaphragm 14*a* is fixed to an inner peripheral portion of the edge 16*a*. An outer peripheral portion of the edge 16*a* is fixed between an upper surface of a side portion of the lower casing 10*a* and a lower surface of a side portion of the upper casing 11*a*. The edge 16*a* supports the diaphragm 14*a* so as to allow the diaphragm 14*a* to vibrate in the Y-axis direction. The drive coil 15*a* is provided on the diaphragm 14*a* so as to be located in a magnetic gap formed by the first magnet 12*a* and the second magnet 13*d*. It is noted that when the drive coil 15*a* is provided in a space formed by linearly connecting an outer circumferential surface of the first magnet 12*a* to an inner circumferential surface of the second magnet 13*d* which faces the center pole 33*ap*, the sound pressure level of the reproduced sound can be maximized.

Alternatively, for example, the front shape of the electro-acoustic transducer 3 may be an elliptical shape, a rectangular shape, or a track shape. With this, the shape of each component such as the first magnet 12, the second magnet 13*d*, and the like may be a shape in accordance with the front shape of the electro-acoustic transducer 3.

In the configuration shown in FIGS. 16 and 17, the second magnets 13*b* and 13*c* are used. However, a magnet which is an elongated annular body may be used. In this case, the second magnet, which is the elongated annular body, is disposed so that a long side portion thereof is parallel to the long side portion of the drive coil 15. The width of the first magnet 12 in the long side direction thereof is caused to be the same as that of the second magnet, which is the elongated annular body, in the long side direction thereof. The width of the first magnet 12 in the short side direction thereof is caused to be smaller than that of the second magnet, which is the annular body, in the short side direction thereof.

Figure 22:
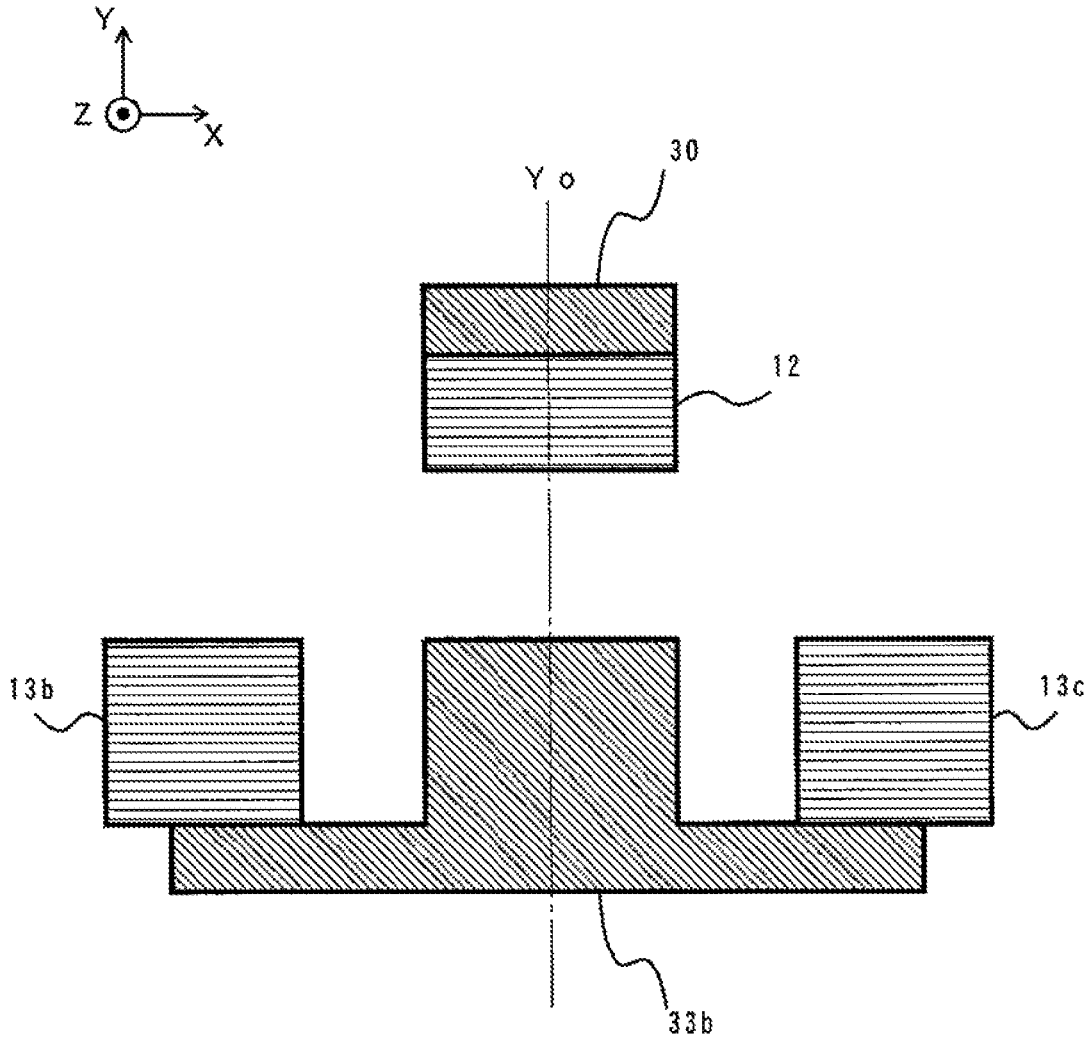
FIG. 22 is a view showing a configuration of a third yoke 33*b*.

With respect to the configuration shown in FIG. 17, a third yoke 33*b* shown in FIG. 22 may be used in place of the third yoke 33. FIG. 22 is a view showing a configuration of the third yoke 33*b*. As shown in FIG. 22, the third yoke 33*b* is a yoke in which the plate section 33*f* is shorter in length in the X-axis direction than that of the third yoke 33. By providing the configuration shown in FIG. 22, a leak magnetic flux by the second magnets 13*b* and 13*c* can be reduced further.

Figure 23:
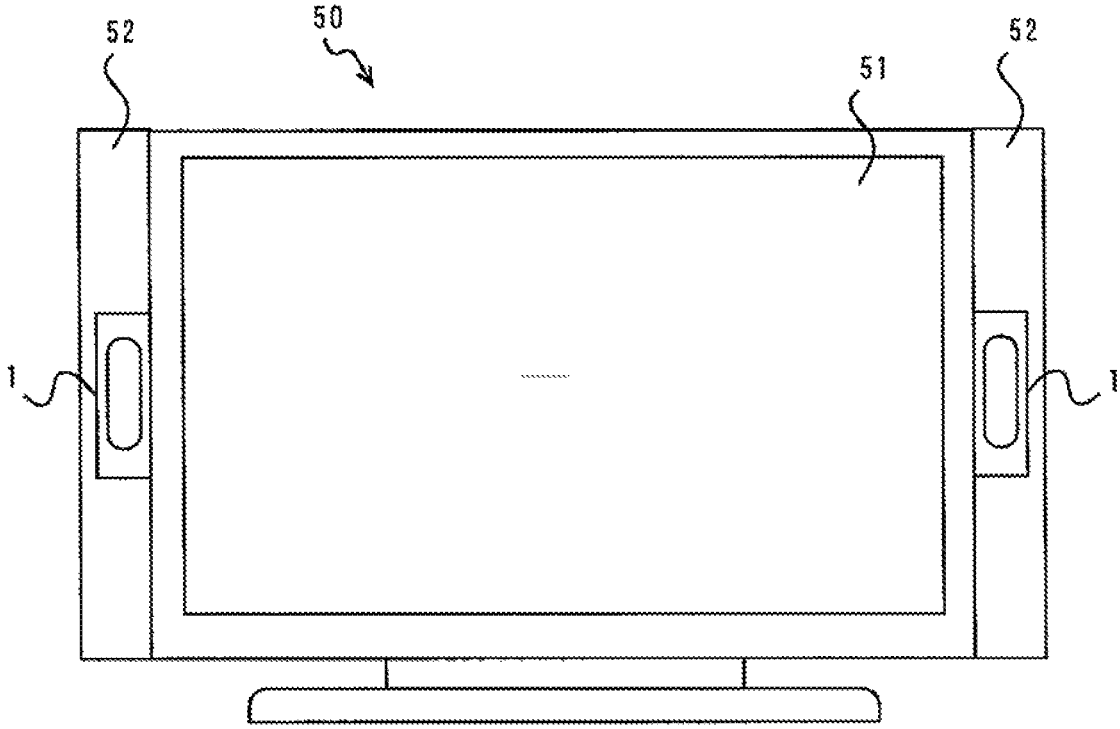
FIG. 23 is a front view of a flat screen television 50.

The electro-acoustic transducers 1 to 3 according to the first to third embodiments described above may be mounted to an electronic device, for example, an audiovisual device, such as an audio set, a personal computer, a television, and the like. The electro-acoustic transducers 1 to 3 are disposed in a device casing provided in the electronic device. The following will describe, as a concrete example, a case where the electro-acoustic transducer 1 is mounted to a flat screen television which is an audiovisual device. FIG. 23 is a front view of a flat screen television 50.

As shown in FIG. 23, a display section 51 is constructed of a plasma display panel or a liquid crystal panel, and displays an image thereon. On both sides of the display section 51, device casings 52 are disposed for mounting therein the electro-acoustic transducers 1, respectively. In each of the device casings 52, a dust-proof net having sound holes is provided at a position where the electro-acoustic transducer 1 is mounted. Or, the device casings 52 are formed with sound holes. The electro-acoustic transducers 1 are disposed so that sound emission surfaces thereof face a viewer.

The following will describe an operation of the flat screen television 50 shown in FIG. 23. A radio wave outputted from a base station is received by an antenna. The received radio wave is converted into an image signal and an audio signal by an electric circuit inside the flat screen television 50. The image signal is displayed on the display section 51, and the audio signal is outputted as sound by the electro-acoustic transducers 1.

Here, as shown in FIG. 23, for causing a breadth of the display section 51 to be large with respect to an overall breadth of the flat screen television 50 as much as possible, namely, for providing a large screen, breadths of the device casings 52 are made small as much as possible. Thus, the breadths (the widths in the short side direction) of the electro-acoustic transducers 1, which are mounted in the device casings 52, are desired to be small. However, in the electro-acoustic transducers 1 to 3 according to the present invention, the two magnets are used at positions which face the diaphragm. Thus, even if the breadth of the electro-acoustic transducer is small, a sufficient sound pressure level can be ensured. Further, by using the electro-acoustic transducers 1 to 3 according to the present invention, the flat screen television 50 can be provided, which provides a large screen while ensuring a certain sound pressure level. Further, in the electro-acoustic transducers 1 to 3 according to the present invention, an area of a surface of the magnet on the side which faces a user (on the sound emission surface side) is smaller (preferably 40% to 70%) than that of the magnet on a back surface side of the flat screen television 50 shown in FIG. 23. Thus, a sound quality is prevented from deteriorating due to the acoustic load, and especially, a sound quality in the extremely high frequency band can be significantly improved. As a result, even in application in which a high sound quality is desired as in a home theater system using the flat screen television 50, and the like, the sound quality is prevented from deteriorating, and high-quality sound can be reproduced in a high-frequency band. As described above, by mounting the electro-acoustic transducers 1 to 3 according to the present invention to the audiovisual device such as the flat screen television 50, and the like, an audiovisual device can be provided, which provides a high reproduced sound pressure and a high sound quality and is excellent in reproducing sound in a high frequency band.

In FIG. 23, the electro-acoustic transducers 1 are mounted in the device casings 52, respectively, but may be mounted in different device casings, respectively. For example, the electro-acoustic transducer 1 may be mounted on a substrate inside the flat screen television 50. Alternatively, the electro-acoustic transducers 1 to 3 may be mounted to other electronic devices, such as a cellular phone, a PDA, a common television, a personal computer, a car navigation system, and the like. As described above, by mounting the electro-acoustic transducers 1 to 3 to various electronic devices, an electronic device capable of reproducing music, sound, and the like can be realized.

The electro-acoustic transducer according to the present invention is capable of reproducing high-quality sound while increasing a driving force generated in a drive coil and preventing deterioration of a sound quality due to distortion of the driving force, and useful for an electro-acoustic transducer used in a home audio, and an electronic device, and the like, for example, an audiovisual device such as an audio set, a personal computer, a television, and the like, which includes the electro-acoustic transducer.

The invention claimed is:

1. An electro-acoustic transducer, comprising:

a diaphragm;

a casing which is formed with an opening in a part thereof for supporting therein the diaphragm so as to allow the diaphragm to vibrate;

a first magnet which is provided on a side of the opening with respect to the diaphragm and polarized in a vibration direction of the diaphragm;

a second magnet which is provided on a side of an inner bottom surface of the casing with respect to the diaphragm so that the diaphragm is interposed between the first magnet and the second magnet and which is polarized in a direction opposite to a polarization direction of the first magnet;

a drive coil which is provided on the diaphragm so as to be located in a magnetic gap formed by a pair of the first and second magnets for generating a driving force which causes the diaphragm to vibrate; and a first yoke for forming a magnetic path in at least a portion around the first magnet, and a second yoke for forming a magnetic path in at least a portion around the second magnet, wherein when the first and second magnets are projected on the diaphragm, a first projected area of the first magnet is smaller than a second projected area of the second magnet, the diaphragm has an elongated shape in which a width in a lateral direction thereof is smaller than a width in a longitudinal direction thereof, the drive coil has an elongated shape in which a width in a lateral direction thereof is smaller than a width in a longitudinal direction thereof, and is provided on the diaphragm so that the longitudinal direction of the drive coil is parallel to the longitudinal direction of the diaphragm, the drive coil has a length in the longitudinal direction thereof, which is 60% or more of a length of the diaphragm in the longitudinal direction thereof, the drive coil and the diaphragm are disposed so that a central axis of the drive coil in a vibration direction thereof substantially coincides with a central axis of the diaphragm in the vibration direction thereof, and the diaphragm is driven over an entire surface thereof with respect to the longitudinal direction thereof, and wherein the first yoke is provided only on a surface of the first magnet opposite to a surface of the first magnet which faces the diaphragm, the second yoke is provided so as to surround surfaces of the second magnet other than a surface of the second magnet which faces the diaphragm, each of the first and second magnets is an elongated rectangular parallelepiped shape having long sides parallel to a long side portion of the drive coil, the first magnet having a same width in a long side direction thereof as a width of the second magnet in a long side direction thereof, and the first magnet has a width in a short side direction thereof, which is smaller than a width of the second magnet in a short side direction thereof, and a width of a first yoke in a short side direction thereof is the same as a width of the first magnet in a short side direction thereof.

2. The electro-acoustic transducer according to claim 1, wherein a width of a second yoke in a short side direction thereof is a same width as a width of the second magnet in a short side direction thereof.

3. The electro-acoustic transducer according to claim 2, wherein the long side portion of the drive coil is provided on the diaphragm and in a position which includes a line connecting an outer periphery of the first magnet in the short side direction thereof to an outer periphery of the second magnet in the short side direction thereof.

4. The electro-acoustic transducer according to claim 3, wherein the first magnet and the second magnet are disposed so that central axes thereof coincide with each other.

5. The electro-acoustic transducer according to claim 1, wherein the drive coil is provided on the diaphragm and in a position, which is outward of an outer periphery of the surface of the first magnet, which faces the diaphragm, and inward of an outer periphery of the surface of the second magnet which faces the diaphragm.

6. The electro-acoustic transducer according to claim 1, wherein a ratio of the first projected area to the second projected area ranges from 40% to 70%.

7. The electro-acoustic transducer according to claim 1, wherein the diaphragm has one of an elongated rectangular shape, an elliptical shape, and a track shape.

8. An electronic device comprising:

an electro-acoustic transducer according to claim 1; and a device casing in which the electro-acoustic transducer is disposed.

9. An audiovisual device comprising:

an electro-acoustic transducer according to claim 1; and a device casing in which the electro-acoustic transducer is disposed.

* * * * *